United States Patent [19]

Wey et al.

[11] 4,414,306

[45] Nov. 8, 1983

[54] SILVER CHLOROBROMIDE EMULSIONS AND PROCESSES FOR THEIR PREPARATION

[75] Inventors: Jong-Shinn Wey, Penfield; Herbert S. Wilgus, Conesus, both of N.Y.

[73] Assignee: Eastman Kodak Company, Rochester, N.Y.

[21] Appl. No.: 431,854

[22] Filed: Sep. 30, 1982

Related U.S. Application Data

[63] Continuation-in-part of Ser. No. 320,899, Nov. 12, 1981, abandoned.

[51] Int. Cl.[3] ..... G03C 1/02; G03C 5/24

[52] U.S. Cl. ..... 430/434; 430/567; 430/569

[58] Field of Search ..... 430/434, 567, 569

[56] References Cited

U.S. PATENT DOCUMENTS

| | | | |
|---|---|---|---|
| 4,063,951 | 12/1977 | Bogg | 430/567 |
| 4,067,739 | 1/1978 | Lewis | 430/567 |
| 4,150,994 | 4/1979 | Maternaghan | 430/567 |
| 4,184,877 | 1/1980 | Maternaghan | 430/567 |
| 4,184,878 | 1/1980 | Maternaghan | 430/567 |

FOREIGN PATENT DOCUMENTS

| | | |
|---|---|---|
| 2905655 | 2/1979 | Fed. Rep. of Germany . |
| 2921077 | 5/1979 | Fed. Rep. of Germany . |
| 55-142329 | 11/1980 | Japan . |
| 1570581 | 7/1980 | United Kingdom . |

OTHER PUBLICATIONS

Claes et al., "Crystal Habit Modification of AgCl by Impurities Determining Solvation", *The Journal of Photographic Science,* vol. 21, pp. 39–50, 1973.

Wyrsch, "Sulfur Sensitization of Monosized Silver Chloride Emulsions with (111), (110), and (100) Crystal Habit", Paper III-13, *International Congress of Photographic Science,* pp. 122–124, 1978.

deCugnac and Chateau, "Evolution of the Morphology of Silver Bromide Crystals During Physical Ripening", *Science et Industries Photographiques,* vol. 33, No. 2, (1962), pp. 121–125.

Duffin, *Photographic Emulsion Chemistry,* Focal Press, 1966, pp. 66–72.

Trivelli and Smith, "The Effect of Silver Iodide Upon the Structure of Bromo-Iodide Precipitation Series", *The Photographic Journal,* vol. LXXX, Jul. 1940, pp. 285–288.

Gutoff, "Nucleation and Growth Rates During the Precipitation of Silver Halide Photographic Emulsions", *Photographic Sciences and Engineering,* vol. 14, No. 4, Jul.–Aug. 1970, pp. 248–257.

*Primary Examiner*—Mary F. Downey

*Attorney, Agent, or Firm*—Carl O. Thomas

[57] ABSTRACT

Tabular grain silver halide emulsions are disclosed containing chloride and bromide in at least annular grain regions. The tabular grains having a thickness of less than 0.5 micron, preferably less than 0.3 micron, a diameter of at least 0.6 micron, and an average aspect ratio of at least 5:1, account for at least 35 percent of the total projected area of the total silver halide grain population. The average molar ratio of chloride to bromide in at least the annular grain regions ranges up to 2:3. The tabular grains containing chloride and bromide in at least annular grain regions are formed by maintaining a molar ratio of chloride and bromide ions of from 1.6:1 to 258:1 and the total concentration of halide ions in the reaction vessel in the range of from 0.10 to 0.90 N during introduction of silver, chloride, and bromide salts into a reaction vessel, thereby favoring the coprecipitation of chloride and bromide in a tabular crystal habit.

36 Claims, 6 Drawing Figures

SILVER CHLOROBROMIDE EMULSIONS AND PROCESSES FOR THEIR PREPARATION

This is a continuation-in-part of copending, commonly assigned U.S. Ser. No. 320,899, filed Nov. 12, 1981, now abandoned.

Field of the Invention

This invention relates to radiation-sensitive silver halide emulsions containing chloride and bromide, processes for the preparation of these emulsions, photographic elements containing these emulsions, and processes for the use of these photographic elements.

BACKGROUND OF THE INVENTION

Radiation-sensitive silver halide photographic emulsions containing silver chloride are known to offer specific advantages. For example, silver chloride exhibits less native sensitivity to the visible portion of the spectrum than other photographically useful silver halides. Further, silver chloride is more soluble than other photographically useful silver halides, thereby permitting development and fixing to be achieved in shorter times. Silver chlorobromide emulsions have found particular utility in applications requiring high contrast, such as graphic arts, and in applications requiring rapid processing, such as black-and-white and color print products.

A great variety of grain shapes have been observed in silver halide photographic emulsions. Although a variety of factors, such as the presence of grain growth modifiers or ripening agents or the choice of double- or single-jet precipitation, can have a substantial impact on crystal configuration, no one factor is of more importance than the halide present during grain precipitation.

It is well recognized in the art that silver chloride strongly favors the formation of crystals having {100} crystal faces. In the overwhelming majority of photographic emulsions silver chloride crystals when present are in the form of cubic grains. With some difficulty is has been possible to modify the crystal habit of silver chloride. Claes et al, "Crystal Habit Modification of AgCl by Impurities Determining the Solvation", *The Journal of Photographic Science,* Vol. 21, pp. 39–50, 1973, teaches the formation of silver chloride crystals with {110} and {111} faces through the use of various grain growth modifiers. Wyrsch, "Sulfur Sensitization of Monosized Silver Chloride Emulsions with {111}, {110} and {100} Crystal Habit", Paper III-13, *International Congress of Photographic Science,* pp. 122–124, 1978, discloses a triple-jet precipitation process in which silver chloride is precipitated in the presence of ammonia and small amounts of divalent cadmium ions. In the presence of cadmium ions control of pAg and pH resulted in the formation of rhombododecahedral {110}, octahedral {111}, and cubic {100} crystal habits.

Tabular silver bromide grains have been extensively studied, often in macro-sizes having no photographic utility. Tabular grains are herein defined as those having two substantially parallel crystal faces, each of which is substantially larger than any other single crystal face of the grain. The term "substantially parallel" as used herein is intended to include surfaces that appear parallel on direct or indirect visual inspection at 10,000 times magnification. The aspect ratio—that is, the ratio of diameter to thickness—of tabular grains is substantially greater than 1:1. High aspect ratio tabular grain silver bromide emulsions were reported by de Cugnac and Chateau, "Evolution of the Morphology of Silver Bromide Crystals During Physical Ripening", *Science et Industries Photographiques,* Vol. 33, No. 2 (1962), pp. 121–125.

From 1937 until the 1950's the Eastman Kodak Company sold a Duplitized® radiographic film product under the name No-Screen X-Ray Code 5133. The product contained as coatings on opposite major faces of a film support sulfur sensitized silver bromide emulsions. Since the emulsions were intended to be exposed by X-radiation, they were not spectrally sensitized. The tabular grains had an average aspect ratio in the range of from about 5 to 7:1. The tabular grains accounted for greater than 50% of the projected area while nontabular grains accounted for greater than 25% of the projected area. The emulsion having the highest average aspect ratio, chosen from several remakes, had an average tabular grain diameter of 2.5 microns, an average tabular grain thickness of 0.36 micron, and an average aspect ratio of 7:1. In other remakes the emulsions contained thicker, smaller diameter tabular grains which were of lower average aspect ratio.

Although tabular grain silver bromoiodide emulsions are known in the art, the presence of iodide is known to restrict aspect ratios. A discussion of tabular silver bromoiodide grains appears in Duffin, *Photographic Emulsion Chemistry,* Focal Press, 1966, pp. 66–72, and Trivelli and Smith, "The Effect of Silver Bromo-Iodide Precipitation Series", *The Photographic Journal,* Vol. LXXX, July 1940, pp. 285–288. Trivelli and Smith observed a pronounced reduction in both grain size and aspect ratio with the introduction of iodide. Gutoff, "Nucleation and Growth Rates During the Precipitation of Silver Halide Photographic Emulsions", *Photographic Sciences and Engineering,* Vol. 14, No. 4, July–August 1970, pp. 248–257, reports preparing silver bromide and silver bromoiodide emulsions of the type prepared by single-jet precipitations using a continuous precipitation apparatus.

Bogg, Lewis, and Maternaghan have recently published procedures for preparing emulsions in which a major proportion of the silver halide is present in the form of tabular grains. Bogg U.S. Pat. No. 4,063,951 teaches forming silver halide crystals of tabular habit bounded by {100} cubic faces and having an aspect ratio (based on edge length) of from 1.5 to 7:1. The tabular grains exhibit square and rectangular major surfaces characteristic of {100} crystal faces. Lewis U.S. Pat. No. 4,067,739 teaches the preparation of silver halide emulsions wherein most of the crystals are of the twinned octahedral type by forming seed crystals, causing the seed crystals to increase in size by Ostwald ripening in the presence of a silver halide solvent, and completing grain growth without renucleation or Ostwald ripening while controlling pBr (the negative logarithm of bromide ion concentration). Maternaghan U.S. Pat. No. 4,150,994, 4,184,877, and 4,184,878, U.K. Pat. No. 1,570,581, and German OLS publications 2,905,655 and 2,921,077 teach the formation of silver halide grains of flat twinned octahedral configuration by employing seed crystals which are at least 90 mole percent iodide. (Except as otherwise indicated, all references to halide percentages are based on silver present in the corresponding emulsion, grain, or grain region being discussed; e.g., a grain consisting of silver chlorobromide containing 60 mole percent bromide also contains 40 mole percent chloride.) Lewis and Maternaghan report increased covering power. Maternaghan states that the emulsions are useful in camera films, both black-and-white and color. Bogg specifically reports an upper limit on aspect ratios to 7:1, and, from the very low aspect ratios obtained by the examples, the 7:1 aspect ratio appears unrealistically high. It appears from repeating examples and viewing the photomicrographs published that the aspect ratios realized by Lewis and Maternaghan were less than 5:1. Although Bogg, Lewis, and Maternaghan refer to the preparation of tabular silver halide emulsions broadly, they provide no specific examples or teachings directed to the preparation of tabular silver chlorobromide emulsions.

Japanese patent application publication 142,329, published Nov. 6, 1980, appears to be essentially cumulative with Maternaghan, but is not restricted to the use of silver iodide seed grains. Further, this publication specifically refers to the formation of tabular silver chlorobromide grains containing less than 50 mole percent chloride. No specific example of such an emulsion is provided, but from an examination of the information provided, it appears that this publication obtained a relatively low proportion of tabular silver halide grains and that the tabular grains obtained are of no higher aspect ratios than those of Maternaghan.

Wey, U.S. Ser. No. 429,403, filed concurrently herewith and commonly assigned, titled IMPROVED DOUBLE-JET PRECIPITATION PROCESSES AND PRODUCTS THEREOF, which is a continuation-in-part of U.S. Ser. No. 320,908, filed Nov. 12, 1981, now abandoned discloses a process of preparing tabular silver chloride grains which are substantially internally free of both silver bromide and silver iodide. The emulsions have an average aspect ratio of greater than 8:1.

Maskasky U.S. Ser. No. 431,455, filed concurrently herewith and commonly assigned, titled SILVER CHLORIDE EMULSIONS OF MODIFIED CRYSTAL HABIT AND PROCESSES FOR THEIR PREPARATION, which is a continuation-in-part of U.S. Ser. No. 320,898, filed Nov. 12, 1981, now abandoned, discloses a process of preparing tabular grains having opposed major crystal faces lying in {111} crystal planes and, in one preferred form, at least one peripheral edge lying perpendicular to a <211> crystallographic vector in the plane of one of the major surfaces. Thus, the crystal edges obtained are crystallographically offset 30° as compared to those of Wey. Maskasky requires that the novel tabular grains be predominantly (that is, at least 50 mole percent) chloride.

Wilgus and Haefner U.S. Ser. No. 429,420, filed concurrently herewith and commonly assigned, titled HIGH ASPECT RATIO SILVER BROMOIODIDE EMULSIONS AND PROCESSES FOR THEIR PREPARATION, which is a continuation-in-part of U.S. Ser. No. 320,905, filed Nov. 12, 1981, now abandoned, discloses high aspect ratio silver bromoiodide emulsions and a process for their preparation.

Kofron et al U.S. Ser. No. 429,407, filed concurrently herewith and commonly assigned, titled SENSITIZED HIGH ASPECT RATIO SILVER HALIDE EMULSIONS AND PHOTOGRAPHIC ELEMENTS, which is a continuation-in-part of U.S. Ser. No. 320,904, filed Nov. 12, 1981, now abandoned, discloses chemically and spectrally sensitized high aspect ratio tabular grain silver halide emulsions and photographic elements incorporating these emulsions.

Daubendiek and Strong U.S. Ser. No. 429,587, filed concurrently herewith and commonly assigned, titled AN IMPROVED PROCESS FOR THE PREPARATION OF HIGH ASPECT RATIO SILVER BROMOIODIDE EMULSIONS, which is a continuation-in-part of U.S. Ser. No. 320,906, filed Nov. 12, 1981, now abandoned, discloses an improvement on the processes of Maternaghan whereby high aspect ratio tabular grain silver bromoiodide emulsions can be prepared.

Abbott and Jones U.S. Ser. No. 430,222, filed concurrently herewith and commonly assigned, titled RADIOGRAPHIC ELEMENTS EXHIBITING REDUCED CROSSOVER, which is a continuation-in-part of U.S. Ser. No. 320,907, filed Nov. 12, 1981, now abandoned, discloses the use of high aspect ratio tabular grain silver halide emulsions in radiographic elements coated on both major surfaces of a radiation transmitting support to control crossover.

Solberg, Piggin, and Wilgus U.S. Ser. No. 431,913, filed concurrently herewith and commonly assigned, titled RADIATION-SENSITIVE SILVER BROMOIODIDE EMULSIONS, PHOTOGRAPHIC ELEMENTS, AND PROCESSES FOR THEIR USE, which is a continuation-in-part of U.S. Ser. No. 320,909, filed Nov. 12, 1981, now abandoned, discloses high aspect ratio tabular grain silver bromoiodide emulsions wherein a higher concentration of iodide is present in an annular region than in a central region of the tabular grains.

Dickerson U.S. Ser. No. 430,574, filed concurrently herewith and commonly assigned, titled FOREHARDENED PHOTOGRAPHIC ELEMENTS AND PROCESSES FOR THEIR USE, which is a continuation-in-part of U.S. Ser. No. 320,910, filed Nov. 12, 1981, now abandoned, discloses producing silver images of high covering power by employing photographic elements containing forehardened high aspect ratio tabular grain silver halide emulsions.

Mignot U.S. Ser. No. 320,912, filed Nov. 12, 1981 and commonly assigned, titled SILVER BROMIDE EMULSIONS OF NARROW GRAIN SIZE DISTRIBUTION AND PROCESSES FOR THEIR PREPARATION discloses high aspect ratio tabular grain silver bromide emulsions wherein the tabular grains are square or rectangular in projected area.

Jones and Hill U.S. Ser. No. 430,092, filed concurrently herewith and commonly assigned, titled PHOTOGRAPHIC IMAGE TRANSFER FILM UNIT, which is a continuation-in-part of U.S. Ser. No. 320,911, filed Nov. 12, 1981, now abandoned, discloses image transfer film units containing tabular grain silver halide emulsions.

Evans et al U.S. Ser. No. 431,912, filed concurrently herewith and commonly assigned, titled DIRECT REVERSAL EMULSIONS AND PHOTOGRAPHIC ELEMENTS USEFUL IN IMAGE TRANSFER FILM UNITS which is a continuation-in-part of U.S. Ser. No. 320,891, filed Nov. 12, 1981, now abandoned, discloses image transfer film units containing tabular grain core-shell silver halide emulsions.

SUMMARY OF THE INVENTION

In one aspect this invention is directed to a radiation-sensitive emulsion comprised of a dispersing medium and silver halide grains including hexagonal tabular grains having opposed, substantially parallel {111} major faces, the tabular grains containing chloride and bromide in at least annular grain regions. The tabular grains having a thickness of less than 0.5 micron, preferably less than 0.3 micron, a diameter of at least 0.6 micron, and an average aspect ratio of at least 5:1, account for at least 35 percent of the total projected area of the silver halide grains. The average molar ratio of chloride to bromide in at least the annular grain regions ranges up to 2:3.

In another aspect, this invention is directed to a photographic element comprised of a support and at least one radiation-sensitive emulsion layer comprised of an emulsion as described above.

In still another aspect, this invention is directed to producing a visible photographic image by processing in an aqueous alkaline solution in the presence of a developing agent an imagewise exposed photographic element as described above.

In an additional aspect, this invention is directed to a process of preparing a radiation-sensitive emulsion comprised of a dispersing medium and silver halide grains containing chloride and bromide by concurrently introducing silver, chloride, and bromide salts into a reaction vessel containing at least a portion of the dispersing medium. The process is characterized by the improvement wherein tabular silver halide grains containing chloride to bromide in a molar ratio of from 1:99 to 2:3 in at least an annular grain region are formed, during introduction of the silver, chloride, and bromide salts, by maintaining a molar ratio of chloride to bromide ions in the reaction vessel of from 1.6:1 to 258:1 and maintaining the total concentration of halide ions in the reaction vessel in the range of from 0.10 to 0.90 N.

The present invention is the first to achieve in a single emulsion the advantages of (1) a predominantly bromide tabular silver halide grain configuration with a substantial proportion of chloride present, (2) aspect ratios of at least 5:1 (and also aspect ratios greater than 8:1—i.e., high aspect ratios), and (3) a high proportion of the total grains containing bromide and chloride being tabular. In a specific preferred form the present invention is the first to provide high aspect ratio silver chlorobromide emulsions in which the halide is predominantly bromide and chloride is present in significant concentrations. This invention for the first time makes possible tabular silver chlorobromide edge growth onto silver halide core grains. This invention is the first to provide emulsions containing tabular grains in which a central region can be of a different silver halide composition than a laterally surrounding annular silver halide grain region comprised of chloride and bromide.

The invention offers an advantageous process for the preparation of these emulsions which does not require ammonia, grain growth modifiers, special peptizers, or seed grains, thereby offering greater freedom in the preparation of tabular grain emulsions containing chloride and bromide.

The invention allows the advantages of tabular grain configuration to be realized in photographic applications in which predominantly bromide silver halide grains containing chloride and bromide are now employed, such as black-and-white and color print materials. The invention allows predominantly bromide silver halide emulsions containing chloride and bromide to be prepared exhibiting high contrast, such as is required in graphic arts applications. The improved silver chlorobromide emulsions of this invention can produce further photographic advantages, such as higher blue speeds than converted halide emulsions of like halide composition.

As taught by Kofron et al, cited above, the speed-granularity relationship and sharpness of photographic images can be improved by employing emulsions according to the present invention, particularly those of large average grain diameters. When spectrally sensitized outside the portion of the spectrum to which they exhibit native sensitivity, the emulsions of the present invention exhibit a large separation in their sensitivity in the region of the spectrum to which they exhibit native sensitivity as compared to the region of the spectrum to which they are spectrally sensitized.

As taught by Abbott and Jones, cited above, use of emulsions according to the present invention in radiographic elements coated on both major surfaces of a radiation transmitting support can reduce crossover or comparable crossover levels can be achieved with the emulsions of the present invention using reduced silver coverages and/or while realizing improved speed-granularity relationships.

As taught by Jones and Hill, cited above, image transfer film units containing emulsions according to the present invention are capable of producing viewable images with less time elapsed after the commencement of processing. Higher contrast of transferred images can be realized with less time of development. Further, the image transfer film units are capable of producing images of improved sharpness. The emulsions of the invention permit reduction of silver coverages and more efficient use of dye image formers in image transfer film units and more advantageous layer order arrangements, elimination or reduction of yellow filter materials, and less image dependence on temperature generally.

DESCRIPTION OF PREFERRED EMBODIMENTS

Figure 1:
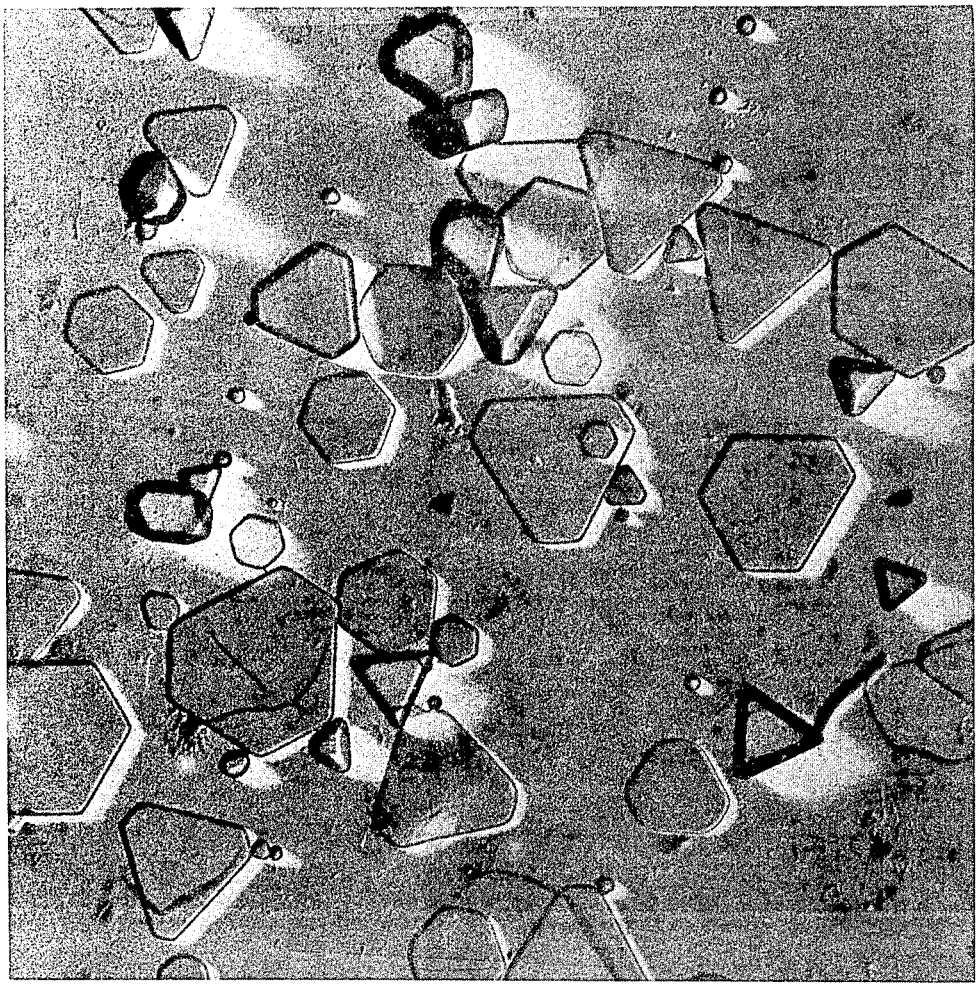
FIGS. 1 and 3 through 5 are shadowed electron micrographs of emulsions according to the present invention.
Figure 2:
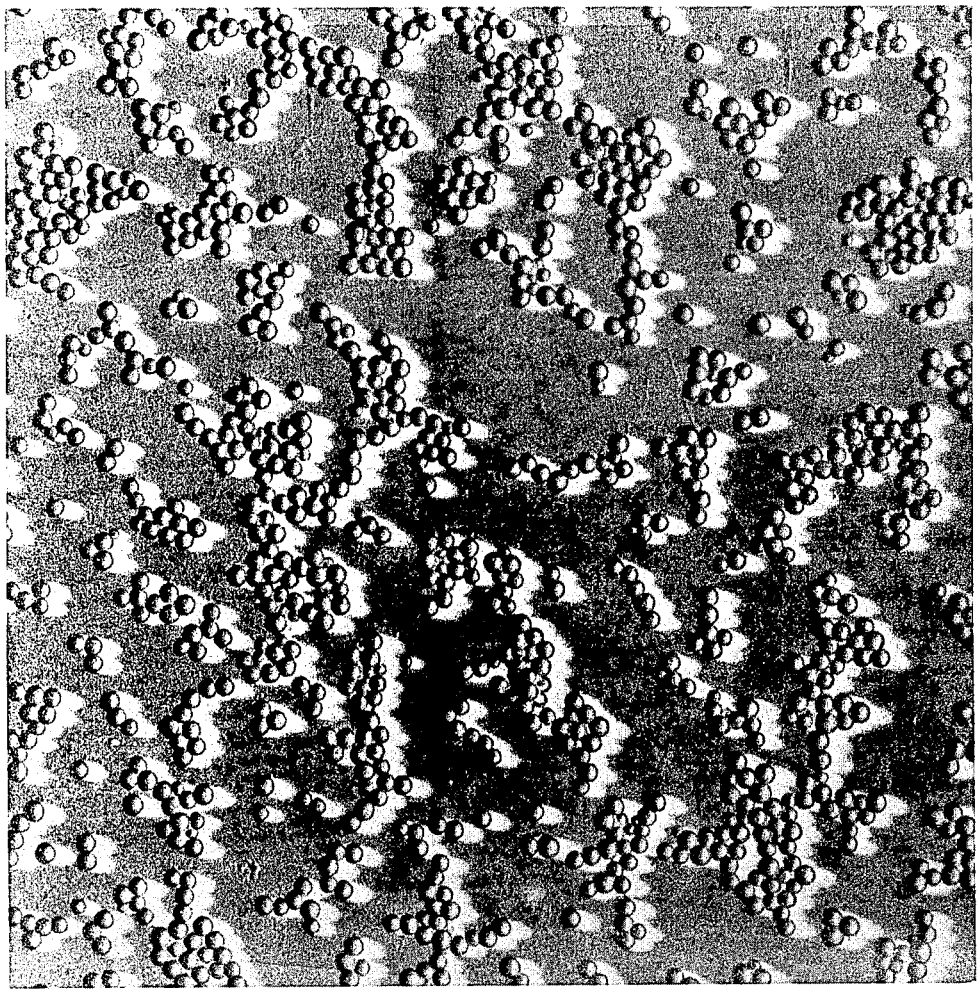
FIG. 2 is a shadowed electron micrograph of a comparative emulsion.
Figure 3:
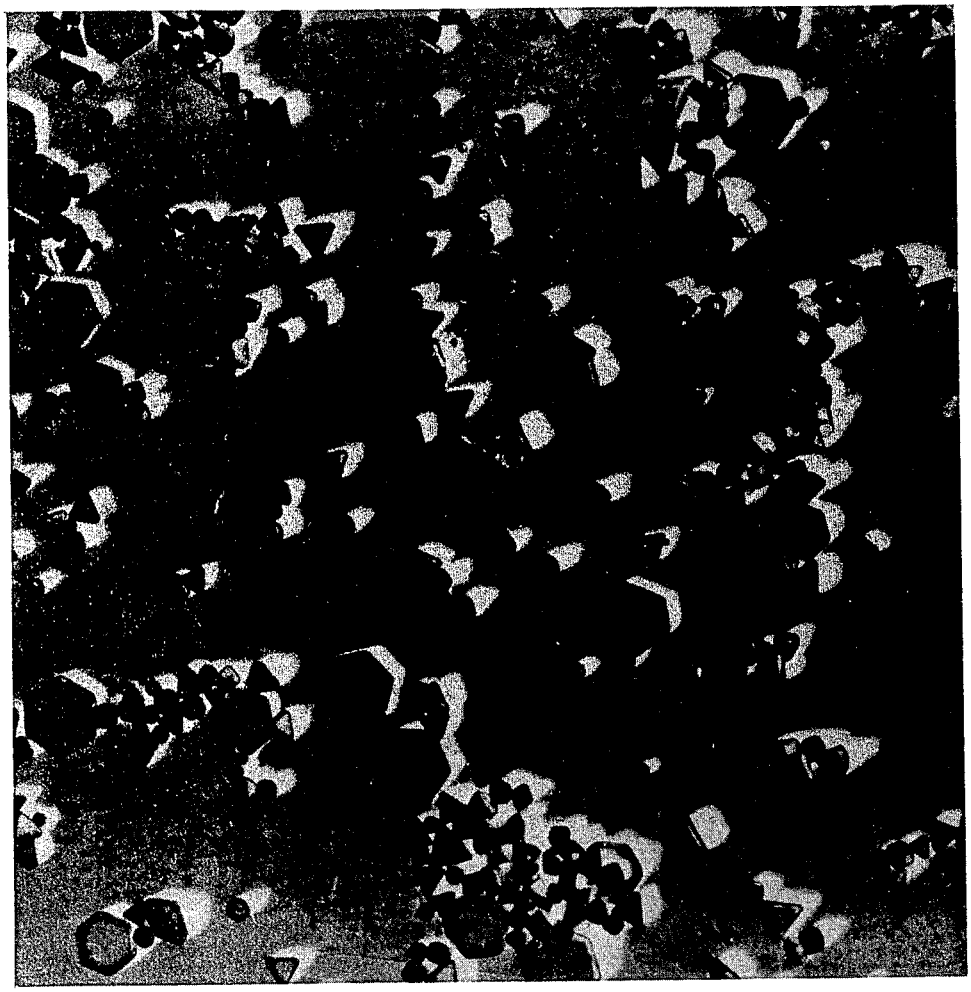
Figure 4:
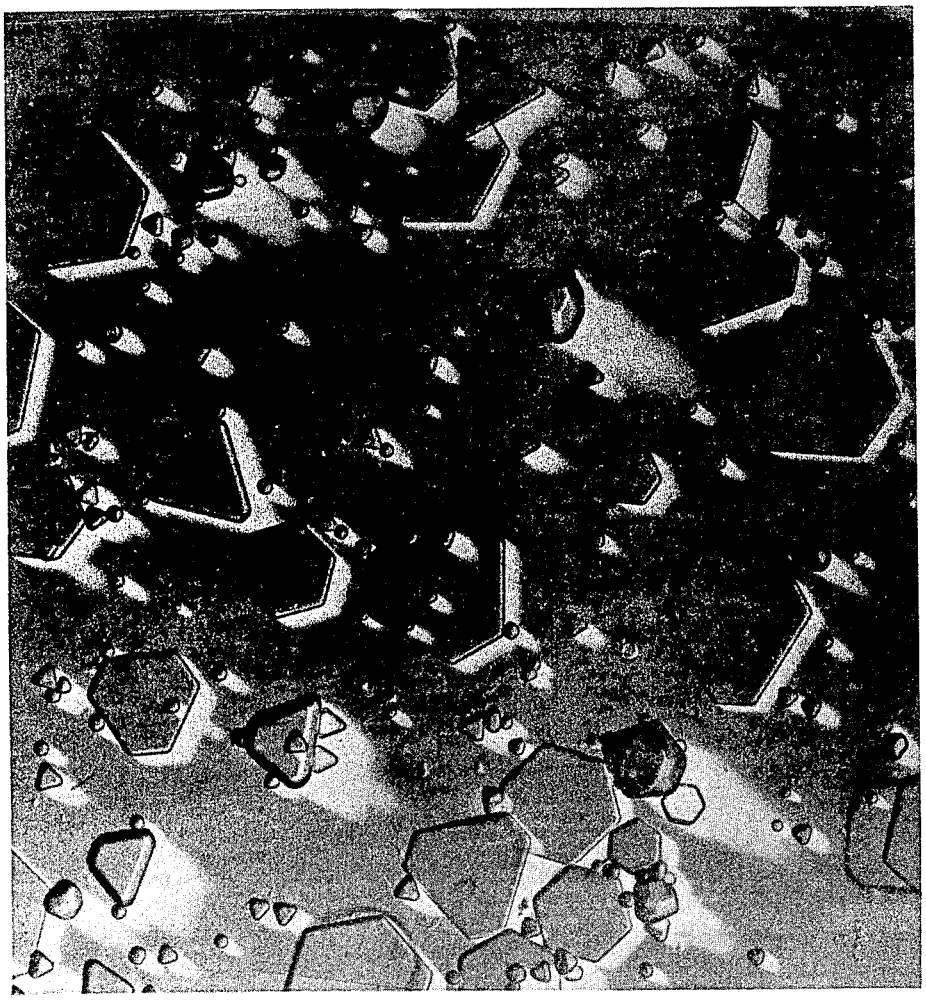
Figure 5:
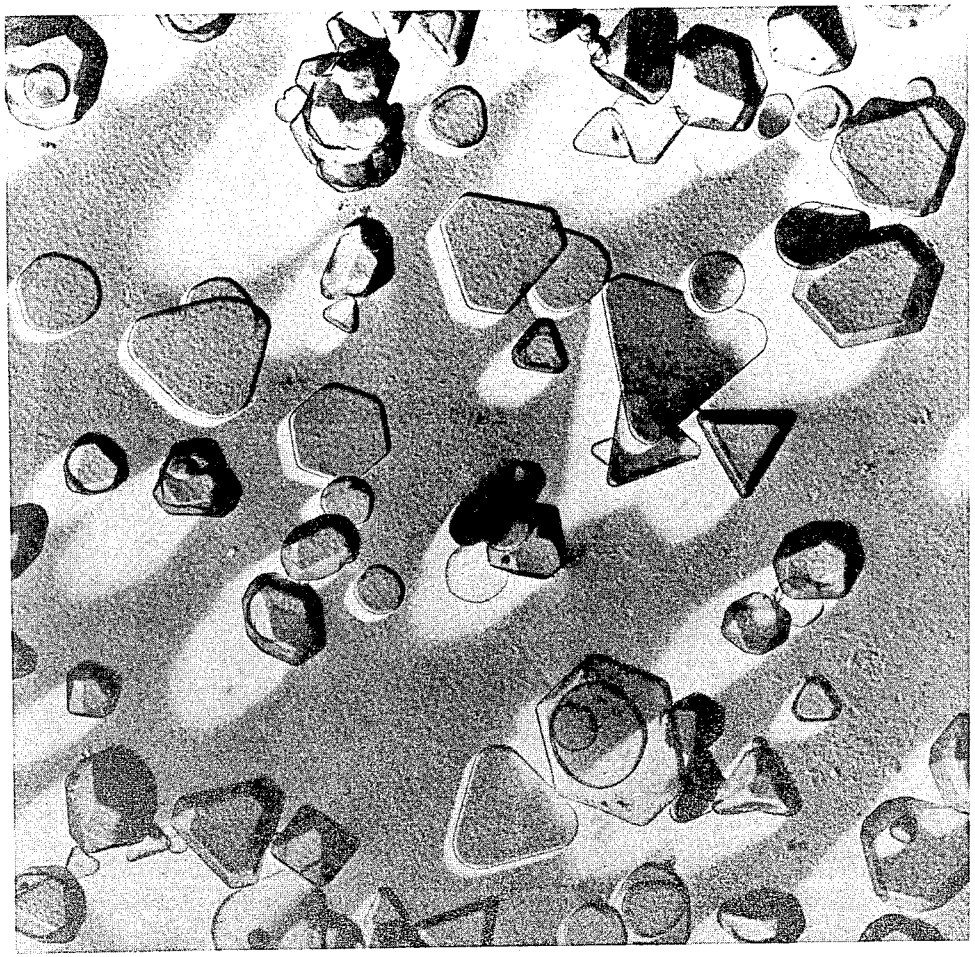

This invention relates to tabular grain silver halide emulsions containing chloride and bromide in at least annular grain regions, to processes for their preparation, to photographic elements which incorporate these emulsions, and to processes for the use of the photographic elements. In a preferred form the emulsions are of high aspect ratio. As applied to the emulsions of the present invention the term "high aspect ratio" is herein defined as requiring that tabular silver halide grain containing chloride and bromide in at least annular grain regions having a thickness of less than 0.3 micron and a diameter of at least 0.6 micron have an average aspect ratio of greater than 8:1 and account for at least 35 percent of the total projected area of the silver halide grains. (All average aspect ratios and projected areas subsequently discussed are similarly determined, unless otherwise stated.)

Although emulsions according to the present invention can have average aspect ratios as low as 5:1, it is preferred that the emulsions have high average aspect ratios of greater than 8:1. Average aspect ratios can range up to 15:1, 30:1, or even higher. The preferred emulsions of the present invention have an average thickness less than 0.2 micron. In a preferred form of the invention these tabular grains account for at least 50 percent and optimally at least 70 percent of the total projected area of the silver halide grains containing chloride and bromide in at least annular grain regions.

It is appreciated that the thinner the tabular grains accounting for a given percentage of the projected area, the higher the average aspect ratio of the emulsion. Typically the tabular grains have an average thickness of at least 0.10 micron, although the tabular grains can in principle be thinner. It is recognized that the tabular grains can be increased in thickness to satisfy specialized applications. For example, Jones and Hill, cited above, contemplate the use of tabular grains having average thicknesses up to 0.5 micron in image transfer film units. (For such an application all references to 0.3 micron in reference to aspect ratio determinations should be adjusted to 0.5 micron.) However, to achieve higher aspect ratios without unduly increasing grain diameters, it is normally contemplated that the tabular grains of the emulsions of this invention will have an average thickness of less than 0.3 micron.

The grain characteristics described above of the emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each grain and to identify those tabular grains having a thickness of less than 0.3 micron and a diameter of at least 0.6 micron. From this the aspect ratio of each such tabular grain can be calculated, and the aspect ratios of all the tabular grains in the sample meeting the less than 0.3 micron thickness and at least 0.6 micron diameter criteria can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.3 micron and a diameter of at least 0.6 micron and to calculate the average aspect ratio as the ratio of these two averages. Whether the averaged individual aspect ratios or the averages of thickness and diameter are used to determine the average aspect ratio, within the tolerances of grain measurements comtemplated, the average aspect ratios obtained do not significantly differ. The projected areas of the tabular silver halide grains containing chloride and bromide in at least annular grain regions meeting the thickness and diameter criteria can be summed, the projected areas of the remaining silver halide grains in the photomicrograph can be summed separately, and from the two sums the percentage of the total projected area of the silver halide grains provided by the grains meeting the thickness and diameter critera can be calculated.

In the above determinations a reference tabular grain thickness of less than 0.3 micron was chosen to distinguish the uniquely thin tabular grains herein contemplated from thicker tabular grains which provide inferior photographic properties. A reference grain diameter of 0.6 micron was chosen, since at lower diameters it is not always possible to distinguish tabular and non-tabular grains in micrographs. The term "projected area" is used in the same sense as the terms "projection area" and "projective area" commonly employed in the art; see, for example, James ahd Higgins, *Fundamentals of Photographic Theory,* Morgan and Morgan, New York, p. 15.

In a specific preferred form of the invention the silver halide grains of the emulsion consist essentially of silver chlorobromide. The molar proportion of chloride to bromide can range up to 2:3. Photographically useful modifying effects are produced by chloride concentrations as low as about 1 mole percent. Chloride concentrations of from 1 to 30 percent are preferred, with concentrations of from 5 to 20 mole percent being optimum for the practice of the invention. The remaining halide can consist essentially of bromide. The proportion of chloride to bromide can be substantially uniform throughout the grains or vary in any desired manner within the ranges indicated above. It is specifically contemplated to have the proportion of chloride to bromide increase substantially from the central grain region to the surrounding annular grain region. The increase can be abrupt or can be graded. A reversed profile of chloride to bromide is also possible. Further, the proportion of chloride to bromide can either increase or decrease in relation to the annular grain region adjacent the grain surface.

In addition to silver, chloride, and bromide the tabular grains of the present invention can, but need not, contain iodide. The amount of iodide present in the tabular grains can be varied widely, provided the indicated proportions of chloride and bromide are maintained. The permissible proportion of iodide depends upon its location in the grain. It is generally preferred that the iodide concentration be less than about 3 mole percent, optimally less than 0.05 mole percent, during grain nucleation—that is, at or near the center of the grain being formed. After nucleation—that is, as laterally surrounding annular grain regions are being grown—much higher concentrations of iodide, up to the solubility limit of silver iodide in the silver chlorobromide crystal region being grown, are contemplated. Thus, iodide concentrations in the annular grain regions can be higher, but preferably are less than 20 mole percent and are optimally less than 15 mole percent. If the iodide concentration in the annular grain regions is higher than the iodide concentration present during tabular grain nucleation, the effect on the completed emulsion can be to raise the iodide concentration in the central grain regions, since migration of iodide can occur during the course of precipitation. The degree of iodide migration will, of course, vary with the conditions of precipitation, particularly conditions that affect silver halide solubility and ripening.

It is contemplated that the iodide concentration of the tabular silver halide grains of the present invention can be substantially uniform throughout or can be varied in any desired manner, subject to the considerations stated above. It is specifically contemplated to have a substantially higher (at least 1 mole percent higher) iodide concentration in annular grain regions. It is contemplated to increase abruptly or grade iodide concentration increases in the grains. The iodide concentration can increase between a central grain region and an annular grain region and then decrease again toward the outer edge of the grain.

The tabular grain silver halide emulsions having at least an annular grain region containing chloride and bromide can be prepared by a precipitation process which also forms a part of the present invention. Into a conventional reaction vessel for silver halide precipitation equipped with an efficient stirring mechanism is introduced a dispersing medium. Typically the dispersing medium initially introduced into the reaction vessel is at least about 10 percent, preferably 20 to 100 percent, by weight, based on total weight of the dispersing medium present in the emulsion at the conclusion of grain precipitation. Since dispersing medium can be removed from the reaction vessel by ultrafiltration during grain precipitation, as taught by Mignot U.S. Pat. No. 4,334,012, here incorporated by reference, it is appreciated that the volume of dispersing medium initially present in the reaction vessel can equal or even exceed the volume of the emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

In the preferred practice of the process in which tabular silver halide grains are formed containing chloride and bromide in the central grain regions, a minor portion, typically less than 10 mole percent, of the chloride and bromide salts employed in forming the tabular grains is initially present in the reaction vessel to adjust the halide ion concentration of the dispersing medium at the outset of precipitation. Although chloride and bromide ions can be present in the concentrations and proportions described below, the dispersing medium in the reaction vessel initially contains less than a 0.05 molar concentration of iodide ions and is preferably initially substantially free of iodide ions, since the presence of iodide ions in the reaction vessel prior to the concurrent introduction of silver, chloride, and bromide salts favors the formation of tabular grains of lower aspect ratios.

During precipitation silver, chloride, bromide, and, optionally, iodide salts are added to the reaction vessel by techniques well known in the art. Typically an aqueous silver salt solution of a soluble silver salt, such as silver nitrate, is introduced into the reaction vessel concurrently with the introduction of the halide salts. The halide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the halide salts. The halide salts are added to the reaction vessel separately or as a mixture.

As an alternative to the introduction of silver and halide salts as aqueous solutions, it is specifically contemplated to introduce the silver and halide salts initially or in the growth stage in the form of fine silver halide grains suspended in dispersing medium. The grain size is such that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver chloride, and/or mixed halide silver halide grains can be introduced. The silver halide grains are preferably very fine—e.g., less than 0.1 micron in mean diameter.

In order to incorporate chloride into the tabular grains in the proportions discussed above it is essential that chloride ion be present in the reaction vessel in a much higher proportion than bromide ion. Specifically, to incorporate a molar ratio of chloride to bromide in the tabular grains of 1:99, it is necessary that at least a 1.6:1 molar ratio of chloride to bromide ions be present in the reaction vessel. To raise the molar ratio of chloride to bromide in the tabular grains to 2:3 it may be necessary, depending upon the temperature of precipitation, to increase the molar ratio of chloride ions to bromide ions in the reaction vessel to 258:1. Representative molar ratio relationships between chloride and bromide ion proportions in the reaction vessel and chloride and bromide resulting in the tabular grains, for extreme precipitation temperatures of 30° and 90° C. and a precipitation at 55° C., which is within the preferred precipitation temperature range of from 40° to 80° C., are set forth below in Table I.

TABLE I

| Cl/Br | $Cl^-:Br^-$ in Reaction Vessel | | |
|---|---|---|---|
| in Grains | 30+ C. | 55° C. | 90° C. |
| 1:99 | 5.6:1 | 3:1 | 1.6:1 |
| 10:90 | 58:1 | 31:1 | 16:1 |
| 15:85 | 84:1 | 47:1 | 24:1 |
| 20:80 | 110:1 | 64:1 | 32:1 |
| 30:70 | 184:1 | 101:1 | 55:1 |
| 40:60* | 258:1 | 145:1 | 77:1 |

*i.e., 2:3

Although only representative values are set forth in Table I, additional values can be ascertained by extrapolation or interpolation.

In order to obtain tabular silver halide grains according to the invention it is additionally necessary to control the total concentration of the halide ions present in the reaction vessel. Total halide ion concentrations in the reaction vessel in the range of from about 0.10 to 0.90 N are necessary to favor the coprecipitation of chloride and bromide in a tabular crystal habit. In order to maximize the proportion of tabular grains of the desired aspect ratio produced during coprecipitation it is preferred to maintain total halide ion concentration in the range of from about 0.30 to about 0.60 N in the reaction vessel.

The precipitation process described above can be employed both to form tabular grain nuclei containing chloride and bromide and to grow the grain nuclei to the desired tabular grain thickness and aspect ratio. Alternatively, the precipitation process can be employed to coprecipitate chloride and bromide in a tabular crystal habit onto silver halide grains previously formed or introduced into the reaction vessel. In this form the process of the present invention is employed to produce only the annular grain region containing silver, chloride, bromide, and, optionally, iodide.

When the process of this invention is used to form only the annular grain region, the silver halide forming the central region of the resulting grain can be of any halide composition having a solubility equal to or less than that or the silver halide introduced to form a laterally surrounding annular region of the grains. In a preferred form of the invention the silver halide grains forming the central grain regions are tabular and no greater in thickness than the desired thickness of the completed tabular grains. The grains forming the central grain regions can be of high aspect ratio, but need not exhibit an aspect ratio of greater than 1:1. Acceptable aspect ratios for the silver halide grains forming the central grain regions will vary depending upon the proportion of the grain to be formed by the central region. If, for example, the central grain region is intended to account for 99 percent of the total grain, then it is apparent that it must be not only tabular, but of an aspect ratio of very nearly 5:1 for the completed grains to exhibit an average aspect ratio of 5:1. On the other hand, if the central grain region accounts for only 1 percent of the completed grain, then the initial aspect ratio of the grains forming the central grain regions can be 1:1 and the process of the present invention in precipitating onto the initially present grains can readily produce tabular grains of at least 5:1 average aspect ratio with chloride and bromide present in the annular grain regions. The specific choice of halide composition for the central grain regions and the proportion of the total grain accounted for by the central grain regions will vary, depending upon the particular photographic application. A wide range of variations are useful and contemplated within the purview of this invention.

By employing the process of the present invention to form the annular grain regions, it is possible to form tabular grain silver halide emulsions according to the present invention in which the central and annular grain regions are of differing halide composition. For example, it is specifically contemplated to form tabular grain emulsions according to the present invention in which the central grain regions consist essentially of silver bromide with silver, chloride, and bromide being present in the annular grain regions. In a specific form the central grain region is itself of high aspect ratio. It is specifically contemplated wholly or partly to form tabular grain silver bromoiodide emulsions according to the teachings of Wilgus and Haefner or Daubendiek and Strong, both cited above and here incorporated by reference, and to thereafter form annular grain regions containing silver, chloride, and bromide according to the present invention. It is also contemplated to form central grain regions of the predominantly silver chloride compositions taught by Wey and Maskasky, both cited above and here incorporated by reference. Again, the central grain regions need not be grown to the aspect ratios required by Wey or Maskasky, since the process of the present invention can be relied upon to increase aspect ratios during growth.

In the course of precipitating silver, chloride, bromide, and, optionally, iodide onto the edges of the central grain regions to form annular grain regions of differing halide content, the silver halide precipitated in forming the annular grain regions selectively precipitates onto the annular grain edges joining the major faces of the tabular grain being formed. Hence, as deposition continues the aspect ratio of the grain is further increased. Some thickening of the core grain regions during precipitation can be experienced, depending upon the specific conditions of precipitation chosen; however, deposition, if any, on the major faces of the tabular grains being formed is at a lower rate than deposition on the annular edges of the tabular grains.

Subject to the requirements set forth above, the concentrations and rates of silver and halide salt introductions can take any convenient conventional form. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS 2,107,118, Teitscheid et al European Patent Application 80102242, and Wey and Strong "Growth Mechanism of AgBr Crystals in Gelatin Solution", *Photographic Science and Engineering,* Vol. 21, No. 1, January/February 1977, p. 14, et. seq.

Modifying compounds can be present during silver halide precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Meuller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and Research Disclosure, Vol. 134, June 1975, Item 13452. Research Disclosure and its predecessor, Product Licensing Index, are publications of Industrial Opportunities Ltd.; Homewell, Havant; Hampshire, P09 1EF, United Kingdom. The tabular grain emulsions can be internally reduction sensitized during precipitation, as illustrated by Moisar et al, *Journal of Photographic Science,* Vol. 25, 1977, pp. 19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304 and Claes et al, *Photographische Korrespondenz,* Band 102, Number 10, 1967, p. 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et at U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. patent application No. 2,022,431A, Saito et al German OLS 2,555,364 and 2,556,885, and *Research Disclosure,* Volume 166, February 1978, Item 16662. *Research Disclosure* and its predecessor, *Product Licensing Index,* are publications of Industrial Opportunities Ltd.; Homewell, Havant; Hampshire, P09 1EF, United Kingdom. The tabular grain emulsions can be internally reduction sensitized during precipitation as illustrated by Moisar et al, *Journal of Photographic Science,* Vol. 25, 1977, pp. 19–27. (As herein defined, pH, pBr, and pAg are defined as the negative logarithm of hydrogen, bromide, and silver ion concentrations, respectively.)

In forming the tabular grain emulsions peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of emulsions according to the present invention. Silver chlorides by reason of their higher levels of solubility are influenced to a lesser extent than other silver halides by ripening agents. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions.

The tabular grain emulsions of the present invention are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pp. 181–185; by diafiltration with a semipermeable membrane, as illustrated by *Research Disclosure, Vol.* 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular grains after the completion of precipitation to avoid increasing their thickness and reducing their aspect ratio.

Although the procedures for preparing tabular silver halide grains described above will produce high aspect ratio tabular grain emulsions in which the tabular grains satisfying the thickness and diameter criteria for aspect ratio account for at least 35 percent of the total projected area of the total silver halide grain population, it is recognized that advantages can be realized by increasing the proportion of such tabular grains present. Preferably at least 50 percent, most preferably at least 70 percent (optimally at least 90 percent) of the total projected area is provided by tabular silver halide grains meeting the thickness and diameter criteria. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation techniques—e.g., by using a centrifuge or hydrocyclone. An illustrative teaching of hydrocyclone separation is provided by Audran et al U.S. Pat. No. 3,326,641.

Once the tabular grain emulsions have been formed by the process of the present invention they can be shelled to produce a core-shell emulsion by procedures well known to those skilled in the art. Any photographically useful silver salt can be employed in forming shells on the high aspect ratio tabular grain emulsions prepared by the present process. Techniques for forming silver salt shells are illustrated by Berriman U.S. Pat. No. 3,367,778, Porter et al U.S. Pat. Nos. 3,206,313 and 3,317,322, Morgan U.S. Pat. No. 3,917,485, and Maternaghan, cited above. Since conventional techniques for shelling do not favor the formation of high aspect ratio tabular grains, as shell growth proceeds the average aspect ratio of the emulsion declines. If conditions favorable for tabular grain formation are present in the reaction vessel during shell formation, shell growth can occur preferentially on the outer edges of the grains so that aspect ratio need not decline, as more fully discussed above.

The tabular grain silver halide emulsions of the present invention are chemically sensitized as taught by Kofron et al, cited above. They can be chemically sensitized with active gelatin, as illustrated by T. H. James, *The Theory of the Photographic Process,* 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 120, April 1974, Item 12008, *Research Disclosure,* Vol. 134, June 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, as described in Damschroder U.S. Pat. No. 2,642,361; sulfur containing compounds of the type disclosed in Lowe et al U.S. Pat. No. 2,521,926, Williams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocyclic nuclei. Exemplary finish modifiers are described in Brooker et al U.S. Pat. No. 2,131,038, Dostes U.S. Pat. No. 3,411,914, Kuwabara et al U.S. Pat. No. 3,554,757, Oguchi et al U.S. Pat. No. 3,565,631, Oftedahl U.S. Pat. No. 3,901,714, Walworth Canadian Patent 778,723, and Duffin *Photographic Emulsion Chemistry,* Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al U.S. Pat. No. 3,984,249, by low pAg (e.g., less than 5) and/or high pH (e.g., greater than 8) treatment or through the use of reducing agents, such as stannous chloride, thiourea dioxide, polyamines and amine-boranes, as illustrated by Allen et al U.S. Pat. No. 2,983,609, Oftedahl et al *Research Disclosure*, Vol. 136, August 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

Although the tabular grain emulsions of the present invention are generally responsive to the techniques for chemical sensitization known in the art in a qualitative sense, in a quantitative sense—that is, in terms of the actual speed increases realized—the tabular grain emulsions require careful investigation to identify the optimum chemical sensitization for each individual emulsion, certain preferred embodiments being more specifically discussed below.

In addition to being chemically sensitized the high aspect ratio tabular grain silver chlorobromide emulsions of the present invention are also spectrally sensitized. It is specifically contemplated to employ spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The emulsions of this invention can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitiving curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", Photographic Science and Engineering, Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering*, Vol. 18, 1974, pp. 49–53 (Sturmer et al), pp. 175–178 (Leubner) and pp. 475–485 (Gilman). Oxidation and reduction potentials can be measured as described by R. F. Large in *Photographic Sensitivity*, Academic Press, 1973, Chapter 15.

The chemistry of cyanine and related dyes is illustrated by Weissberger and Taylor, *Special Topics of Heterocyclic Chemistry*, John Wiley and Sons, New York, 1977, Chapter VIII; Venkataraman, *The Chemistry of Synthetic Dyes*, Academic Press, New York, 1971, Chapter V; James, *The Theory of the Photographic Process*, 4th Ed., Macmillan, 1977, Chapter 8, and F. M. Hamer, *Cyanine Dyes and Related Compounds*, John Wiley and Sons, 1964.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (Reissue 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,178,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,390; sulfonated aromatic compounds, as taught by Jones et al U.S. Pat. No. 2,937,089; mercapto-substituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above. (It should be noted that when iodide is employed to improve spectral sensitization, it can displace halide present in the crystal lattice at the grain surface, thereby converting the grains to silver haloiodide grains.)

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the high aspect ratio tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.*, Vol. 56, p. 1065, 1952; Spence et al, "Desensitization of Sensitizing Dyes", *Journal of Physical and Colloid Chemistry*, Vol. 56, No. 6, June 1948, pp. 1090–1103; and Gilman et al. U.S. Pat. No. 3,979,213. Optimum dye concentration levels can be chosen by procedures taught by Mees, *Theory of the Photographic Process*, 1942, Macmillan, pp. 1067–1069.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al U.S. Pat. No. 3,628,960, and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including cycling, during chemical and/or spectral sensitization. A specific example of pAg adjustment is provided by *Research Disclosure*, Vol. 181, May 1979, Item 18155.

In one preferred form, spectral sensitizers can be incorporated in the emulsions of the present invention after precipitation of silver halide is complete, but prior to chemical sensitization. Similar results have also been achieved in some instances by introducing other adsorbable materials, such a finish modifiers, into the emulsions prior to chemical sensitization.

Independent of the prior incorporation of adsorbable materials, it is preferred to employ thiocyanates during chemical sensitization in concentrations of from about $2\times10^{-1}$ to 2 mole percent based on silver, as taught by Damschroder U.S. Pat. No. 2,642,361. Other ripening agents can be used during chemical sensitization.

In still a third approach, which can be practiced in combination with one or both of the above approaches or separately thereof, Maskasky U.S. Ser. No. 431,855, filed concurrently herewith and commonly assigned, titled CONTROLLED SITE EPITAXIAL SENSITIZATION, which is a continuation-in-part of U.S. Ser. No. 320,920, filed Nov. 12, 19781, now abandoned, both here incorporated by reference, discloses the chemical sensitization of spectrally sensitized high aspect ratio tabular grain emulsions at one or more ordered discrete sites of the tabular grains. It is believed that the preferential absorption of spectral sensitizing dye on the crystallographic surfaces forming the major faces of the tabular grains allows chemical sensitization to occur selectively at unlike crystallographic surfaces of the tabular grains. Deposition of silver halide at the corners of the tabular grains with dye selectively adsorbed increases the sensitivity of the grains, and conventional chemical sensitization thereafter can further increase the sensitivity of the emulsion.

Although not required to realize all of their advantages, the emulsions of the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 $(1-\log E)$, where E is measured in meter-candle-seconds at a density of 0.1 above fog. Once the silver halide grain content of an emulsion has been ascertained it is possible to estimate from further product analysis and performance evaluation whether a product appears to be substantially optimally chemically and spectrally sensitized in relation to comparable commercial offerings of other manufacturers. To achieve the sharpness advantages of the present invention it is immaterial whether the silver halide emulsions are chemically or spectrally sensitized efficiently or inefficiently.

Once tabular grain emulsions have been generated by precipitation procedures, washed, and sensitized, as described above, their preparation can be completed by the incorporation of conventional photographic addenda, and they can be usefully applied to photographic applications requiring a silver image to be produced—e.g., conventional black-and-white photography.

Dickerson, cited above and here incorporated by reference, discloses that hardening photographic elements according to the present invention intended to form silver images to an extent sufficient to obviate the necessity of incorporating additional hardener during processing permits increased silver covering power to be realized as compared to photographic elements similarly hardened and processed, but employing nontabular or less than high aspect ratio tabular grain emulsions. Specifically, it is taught to harden the high aspect ratio tabular grain emulsion layers and other hydrophilic colloid layers of black-and-white photographic elements in an amount sufficient to reduce swelling of the layers to less than 200 percent, percent swelling being determined by (a) incubating the photographic element at 38° C. for 3 days at 50 percent relative humidity, (b) measuring layer thickness, (c) immersing the photographic element in distilled water at 21° C. for 3 minutes, and (d) measuring change in layer thickness. Although hardening of the photographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure*, Vol. 184, August 1979, Item 18431, Paragraph K, relating particularly to the processing of radiographic materials.

Typical useful incorporated hardeners (forehardeners) include formaldehyde and free dialdehydes, such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013, and Yamamoto et al U.S. Pat. No. 3,819,608; α-diketones, as illustrated by Allen et al U.S. Pat. No. 2,725,305; active esters of the type described by Burness et al U.S. Pat. No. 3,542,558; sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861; s-triazines and diazines, as illustrated by Yamamoto et al U.S. Pat. No. 3,325,287, Anderau et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Pat. No. 1,085,663; aziridines, as illustrated by Allen et al U.S. Pat. No. 2,950,197, Burness et al U.S. Pat. No. 3,271,175 and Sato et al U.S. Pat. No. 3,575,705; active olefins having two or more active vinyl groups (e.g. vinylsulfonyl groups), as illustrated by Burness et al U.S. Pat. Nos. 3,490,911, 3,539,644 and 3,841,872 (Reissue 29,305), Cohen U.S. Pat. No. 3,640,720, Kleist et al German Pat. No. 872,153 and Allen U.S. Pat. No. 2,992,109; blocked active olefins, as illustrated by Burness et al U.S. Pat. No. 3,360,372 and Wilson U.S. Pat. No. 3,345,177; carbodiimides, as illustrated by Blout et al German Pat. No. 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoyloxypyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,019, 'onium substituted acroleins, as illustrated by Tschopp et al U.S. Pat. No. 3,792,021, and vinyl sulfones containing other hardening functional groups, as illustrated by Sera et al U.S. Pat. No. 4,028,320; and polymeric hardeners, such as dialdehyde starches, as illustrated by Jeffreys et al U.S. Pat. No. 3,057,723, and copoly(acrolein-methacrylic acid), as illustrated by Himmelmann et al U.S. Pat. No. 3,396,029.

The use of forehardeners in combination is illustrated by Sieg et al U.S. Pat. No. 3,497,358, Dallon et al U.S. Pat. No. 3,832,181 and 3,840,370 and Yamamoto et al U.S. Pat. No. 3,898,089. Hardening accelerators can be used, as illustrated by Sheppard et al U.S. Pat. No. 2,165,421, Kleist German Pat. No. 881,444, Riebel et al U.S. Pat. No. 3,628,961 and Ugi et al U.S. Pat. No. 3,901,708. The patents illustrative of hardeners and hardener combinations are here incorporated by reference.

Instability which increases minimum density in negative type emulsion coatings (i.e., fog) or which increases minimum density or decreases maximum density in direct-positive emulsion coatings can be protected against by incorporation of stabilizers, antifoggants, antikinking agents, latent image stabilizers and similar addenda in the emulsion and contiguous layers prior to coating. Many of the antifoggants which are effective in emulsions can also be used in developers and can be classified under a few general headings, as illustrated by C.E.K. Mees, *The Theory of the Photographic Process*, 2nd Ed., Macmillan, 1954, pp. 677–680.

To avoid such instability in emulsion coatings stabilizers and antifoggants can be employed, such as halide ions (e.g., bromide salts); chloropalladates and chloropalladites, as illustrated by Trivelli et al U.S. Pat. No. 2,566,263; water-soluble inorganic salts of magnesium, calcium, cadmium, cobalt, manganese and zinc, as illustrated by Jones U.S. Pat. No. 2,839,405 and Sidebotham U.S. Pat. No. 3,488,709; mercury salts, as illustrated by Allen et al U.S. Pat. No. 2,728,663; selenols and diselenides, as illustrated by Brown et al U.K. Pat. No. 1,336,570 and Pollet et al U.K. Pat. No. 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes, as illustrated by Thiers et al U.S. Pat. No. 3,630,744; isothiourea derivatives, as illustrated by Herz et al U.S. Pat. No. 3,220,839 and Knott et al U.S. Pat. No. 2,514,650; thiazolidines, as illustrated by Scavron U.S. Pat. No. 3,565,625; peptide derivatives, as illustrated by Maffet U.S. Pat. No. 3,274,002; pyrimidines and 3-pyrazolidones, as illustrated by Welsh U.S. Pat. No. 3,161,515 and Hood et al U.S. Pat. No. 2,751,297; azotriazoles and azotetrazoles, as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure*, Vol. 134, June 1975, Item 13452, and Vol. 148, August 1976, Item 14851, and Nepker et al U.K. Pat. No. 1,338,567; mercaptotetrazoles, -triazoles and -diazoles, as illustrated by Kendall et al U.S. Pat. No. 2,403,927, Kennard et al U.S. Pat. No. 3,266,897, *Research Disclosure*, Vol. 116, December 1973, Item 11684, Luckey et al U.S. Pat. No. 3,397,987 and Salesin U.S. Pat. No. 3,708,303; azoles, as illustrated by Peterson et al U.S. Pat. No. 2,271,229 and *Research Disclosure*, Item 11684, cited above; purines, as illustrated by Sheppard et al U.S. Pat. No. 2,319,090, Birr et al U.S. Pat. No. 2,152,460, *Research Disclosure*, Item 13452, cited above, and Dostes et al French Pat. No. 2,296,204 and polymers of 1,3-dihydroxy(and/or 1,3-carbamoxy)-2-methylenepropane, as illustrated by Saleck et al U.S. Pat. No. 3,926,635.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Pat. No. 1,466,024 and Habu et al U.S. Pat. No. 3,929,486; quaternary ammonium salts of the type illustrated by Piper U.S. Pat. No. 2,886,437; water-insoluble hydroxides, as illustrated by Maffet U.S. Pat. No. 2,953,455; phenols, as illustrated by Smith U.S. Pat. Nos. 2,955,037 and '038; ethylene diurea, as illustrated by Dersch U.S. Pat. No. 3,582,346; barbituric acid derivatives, as illustrated by Wood U.S. Pat. No. 3,617,290; boranes, as illustrated by Bigelow U.S. Pat. No. 3,725,078; 3-pyrazolidinones, as illustrated by Wood U.K. Pat. No. 1,158,059 and aldoximines, amides, anilides and esters, as illustrated by Butler et al U.K. Pat. No. 988,052.

The emulsions can be protected from fog and desensitization caused by trace amounts of metals such as copper, lead, tin, iron and the like, by incorporating addenda, such as sulfocatechol-type compounds, as illustrated by Kennard et al U.S. Pat. No. 3,236,652; aldoximines, as illustrated by Carroll et al U.K. Pat. No. 623,448 and meta- and poly-phosphates, as illustrated by Draisbach U.S. Pat. No. 2,239,284, and carboxylic acids such as ethylenediamine tetraacetic acid, as illustrated by U.K. Pat. No. 691,715.

Among stabilizers useful in layers containing synthetic polymers of the type employed as vehicles and to improve covering power are monohydric and polyhydric phenols, as illustrated by Forsgard U.S. Pat. No. 3,043,697; saccharides, as illustrated by U.K. Pat. No. 897,497 and Stevens et al U.K. Pat. No. 1,039,471 and quinoline derivatives, as illustrated by Dersch et al U.S. Pat. No. 3,446,618.

Among stabilizers useful in protecting the emulsion layers against dichroic fog are addenda, such as salts of nitron, as illustrated by Barbier et al U.S. Pat. Nos. 3,679,424 and 3,820,998; mercaptocarboxylic acids, as illustrated by Willems et al U.S. Pat. No. 3,600,178, and addenda listed by E. J. Birr, *Stabilization of Photographic Silver Halide Emulsions,* Focal Press, London, 1974, pp. 126–218.

Among stabilizers useful in protecting emulsion layers against development fog are addenda such as azabenzimidazoles, as illustrated by Bloom et al U.K. Pat. No. 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like, as illustrated by Brooker et al U.S. Pat. No. 2,131,038, Land U.S. Pat. No. 2,704,721, Rogers et al U.S. Pat. No. 3,265,498; mercapto-substituted compounds, e.g. mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives, as illustrated by Herz et al U.S. Pat. No. 3,220,839, and thiodiazole derivatives, as illustrated by von Konig U.S. Pat. No. 3,364,028 and von Konig et al U.K. Pat. No. 1,186,441.

Where hardeners of the aldehyde type are employed, the emulsion layers can be protected with antifoggants, such as monohydric and polyhydric phenols of the type illustrated by Sheppard et al U.S. Pat. No. 2,165,421; nitro-substituted compounds of the type disclosed by Rees et al U.K. Pat. No. 1,269,268; poly(alkylene oxides), as illustrated by Valbusa U.K. Pat. No. 1,151,914, and mucohalogenic acids in combination with urazoles, as illustrated by Allen et al U.S. Pat. No. 3,232,761 and 3,232,764, or further in combination with maleic acid hydrazide, as illustrated by Rees et al U.S. Pat. No. 3,295,980.

To protect emulsion layers coated on linear polyester supports addenda can be employed such as parabanic acid, hydantoin acid hydrazides and urazoles, as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate, as illustrated by Overman U.S. Pat. No. 2,628,167; compounds, polymeric latices and dispersions of the type disclosed by Jones et al U.S. Pat. Nos. 2,759,821 and '822; azole and mercaptotetrazole hydrophilic colloid dispersions of the type disclosed by *Research Disclosure,* Vol. 116, December 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide), as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased for can be controlled by selected combinations of addenda, vehicles, hardeners and/or processing conditions, as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure,* Vol. 99, July 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing th pAg of an emulsion and adding gelatin, which are known to retard latent image fading, latent image stabilizers can be incorporated, such as amino acids, as illustrated by Ezekiel U.K. Pat. Nos. 1,335,923, 1,378,354, 1,387,654 and 1,391,672, Ezekial et al U.K. Pat. No. 1,394,371, Jefferson U.S. Pat. No. 3,843,372, Jefferson et al U.K. Pat. No. 1,412,294 and Thurston U.K. Pat. No. 1,343,904; carbonyl-bisulfite addition products in combination with hydroxybenzene or aromatic amine developing agents, as illustrated by Seiter et al U.S. Pat. No. 3,424,583; cycloalkyl-1,3-diones, as illustrated by Beckett et al U.S. Pat. No. 3,447,926; enzymes of the catalase type, as illustrated by Matejec et al U.S. Pat. No. 3,600,182; halogen-substituted hardeners in combination with certain cyanine dyes, as illustrated by Kumai et al U.S. Pat. No. 3,881,933; hydrazides, as illustrated by Honig et al U.S. Pat. No. 3,386,831; alkenylbenzothiazolium salts, as illustrated by Arai et al U.S. Pat. No. 3,954,478; soluble and sparingly soluble mercaptides, as illustrated by Herz U.S. Pat. No. 4,374,196 commonly assigned and here incorporated by reference; hydroxysubstituted benzylidene derivatives, as illustrated by Thurston U.K. Pat. No. 1,308,777 and Ezekiel et al U.K. Pat. Nos. 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives, as illustrated by Ezekiel U.K. Pat. No. 1,389,089; propynylthio derivatives of benzimidazoles, pyrimidines, etc., as illustrated by von Konig et al U.S. Pat. No. 3,910,791; combinations of iridium and rhodium compounds, as disclosed by Yamasue et al U.S. Pat. No. 3,901,713; sydnones or sydnone imines, as illustrated by Noda et al U.S. Pat. No. 3,881,939; thiazolidine derivatives, as illustrated by Ezekiel U.K. Pat. No. 1,458,197 and thioether-substituted imidazoles, as illustrated by *Research Disclosure,* Vol. 136, August 1975, Item 13651.

In addition to sensitizers, hardeners, and antifoggants and stabilizers, a variety of other conventional photographic addenda can be present. The specific choice of addenda depends upon the exact nature of the photographic application and is well within the capability of the art. A variety of useful addenda are disclosed in *Research Disclosure,* Vol. 176, December 1978, Item 17643, here incorporated by reference. Optical brighteners can be introduced, as disclosed by Item 17643 at Paragraph V. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

In accordance with established practices within the art it is specifically contemplated to blend the tabular grain emulsions of the present invention with each other or with conventional emulsions to satisfy specific emulsion layer requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape intermediate its toe and shoulder. To accomplish this the emulsions of this invention can be blended with conventional silver halide emulsions, such as those described in Item 17643, cited above, Paragraph I.

In their simplest form photographic elements according to the present invention employ a single emulsion layer containing a tabular grain silver chlorobromide emulsion according to the present invention and a photographic support. It is, of course, recognized that more than one silver halide emulsion layer as well as overcoat, subbing, and interlayers can be usefully included. Instead of blending emulsions as described above the same effect can usually by achieved by coating the emulsions to be blended as separate layers. Coating of separate emulsion layers to achieve exposure latitude is well known in the art, as illustrated by Zelikman and Levi, *Making and Coating Photographic Emulsions.* Focal Press, 1964, pp. 234–238; Wyckoff U.S. Pat. No. 3,663,228; and U.K. Pat. No. 923,045. It is further well known in the art that increased photographic speed can be realized when faster and slower emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamides, homo- and co-polymers of vinyl chloride, poly(vinyl acetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an $\alpha$-olefin containing 2 to 10 carbon atoms, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al U.S. Pat. No. 3,478,128, are preferably employed as resin coatings over paper, as illustrated by Crawford et al U.S. Pat. No. 3,411,908 and Joseph et al U.S. Pat. No. 3,630,740, over polystyrene and polyester film supports, as illustrated by Crawford et al U.S. Pat. No. 3,630,742, or can be employed as unitary flexible reflection supports, as illustrated by Venor et al U.S. Pat. No. 3,973,963.

Preferred cellulose ester supports are cellulose triacetate supports, as illustrated by Fordyce et al U.S. Pat. Nos. 2,492,977, '978 and 2,739,069, as well as mixed cellulose ester supports, such as cellulose acetate propionate and cellulose acetate butyrate, as illustrated by Fordyce et al U.S. Pat. No. 2,739,070.

Preferred polyester film supports are comprised of linear polyester, such as illustrated by Alles et al U.S. Pat. No. 2,627,088, Wellman U.S. Pat. No. 2,720,503, Alles U.S. Pat. No. 2,779,684 and Kibler et al U.S. Pat. No. 2,901,466. Polyester films can be formed by varied techniques, as illustrated by Alles, cited above, Czerkas et al U.S. Pat. No. 3,663,683 and Williams et al U.S. Pat. No. 3,504,075, and modified for use of photographic film supports, as illustrated by Van Stappen U.S. Pat. No. 3,227,576, Nadeau et al U.S. Pat. No. 3,501,301, Reedy et al U.S. Pat. No. 3,589,905, Babbitt et al U.S.

Pat. No. 3,850,640, Bailey et al U.S. Pat. No. 3,888,678, Hunter U.S. Pat. No. 3,904,420 and Mallinson et al U.S. Pat. No. 3,928,697.

The photographic elements can employ supports which are resistant to dimensional change at elevated temperatures. Such supports can be comprised of linear condensation polymers which have glass transition temperatures above about 190° C., preferably 220° C., such as polycarbonates, polycarboxylic esters, polyamides, polysulfonamides, polyethers, polyimides, polysulfonates and copolymer variants, as illustrated by Hamb U.S. Pat. No. 3,634,089 and 3,772,405; Hamb et al U.S. Pat. Nos. 3,725,070 and 3,793,249; Wilson *Research Disclosure,* Vol. 118, February 1974, Item 11833, and Vol. 120, April 1974, Item 12046; Conklin et al *Research Disclosure,* Vol. 120, April 1974, Item 12012; *Product Licensing Index,* Vol. 92, December 1971, Items 9205 and 9207; *Research Disclosure,* Vol. 101, September 1972, Items 10119 and 10148; *Research Disclosure,* Vol. 106, February 1973, Item 10613; *Research Disclosure,* Vol. 117, January 1974, Item 11709, and *Research Disclosure,* Vol. 134, June 1975, Item 13455.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application W080/01614, published Aug. 7, 1980, (Belgian Pat. No. 881,513, Aug. 1, 1980, corresponding), Blazey et al U.S. Pat. No. 4,307,165, and Gilmour et al U.S. Ser. No. 293,080, filed Aug. 17, 1981, here incorporated by reference. Microcells can range from 1 to 200 microns in width and up to 1000 mircons in depth. It is generally preferred that the microcells be at least 4 microns in width and less than 200 microns in depth, with optimum dimensions being about 10 to 100 microns in width and depth for ordinary black-and-white imaging applications—particularly where the photographic image is intended to be enlarged.

The photographic elements of the present invention can be imagewise exposed in any conventional manner. Attention is directed to *Research Disclosure* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography-Materials, Processes and Systems,* VanNostrand Reinhold Company, 7th Ed., 1977.

Included among the processing methods are web processing as illustrated by Tregillus et al U.S. Pat. No. 3,179,517; stabilization processing, as illustrated by Herz et al U.S. Pat. No. 3,220,839, Cole U.S. Pat. No. 3,615,511, Shipton et al U.K. Pat. No. 1,258,906 and Haist et al U.S. Pat. No. 3,647,453; monobath processing as described in Haist, *Monobath Manual,* Morgan and Morgan, Inc., 1966, Schuler U.S. Pat. No. 3,240,603, Haist et al U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al U.S. Pat. No. 3,232,761; roller transport processing, as illustrated by Russell et al U.S. Pat Nos. 3,025,779 and 3,515,556, Masseth U.S. Pat. No. 3,573,914, Taber et al U.S. Pat. No. 3,647,459 and Rees et al U.K. Pat. No. 1,269,268; alkaline vapor processing, as illustrated by *Product Licensing Index,* Vol. 97, May 1972, Item 9711, Goffe et al U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; reversal processing, as illustrated by Henn et al U.S. Pat. No. 3,576,633; and surface application processing, as illustrated by Kitze U.S. Pat. No. 3,418,132.

Once a silver image has been formed in the photographic element, it is conventional practice to fix the undeveloped silver halide. The high aspect ratio tabular grain emulsions of the present invention are particularly advantageous in allowing fixing to be accomplished in a shorter time period. This allows processing to be accelerated.

The photographic elements and the techniques described above for producing silver images can be readily adapted to provide a colored image through the use of dyes. In perhaps the simplest approach to obtaining a projectable color image a conventional dye can be incorporated in the support of the photographic element, and silver image formation undertaken as described above. In areas where a silver image is formed the element is rendered substantially incapable of transmitting light therethrough, and in the remaining areas light is transmitted corresponding in color to the color of the support. In this way a colored image can be readily formed. The same effect can also be achieved by using a separate dye filter layer or element with a transparent support element.

The silver halide photographic elements can be used to form dye images therein through the selective destruction or formation of dyes. The photographic elements described above for forming silver images can be used to form dye images by employing developers containing dye image formers, such as color couplers, as illustrated by U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602, and Pilato U.S. Pat. No. 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al, *Die Chemie*, Vol. 57, 1944, p. 113, Mannes et al U.S. Pat. No. 2,304,940, Martinez U.S. Pat. No. 2,269,158, Jelley et al U.S. Pat. No. 2,322,027, Forlich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure*, Vol. 159, July 1977, Item 15930. The dye-forming couplers can be incorporated in different amounts to achieve differing photographic effects. For example, U.K. Pat. No. 923,045 and Kumai et al U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwhara et al U.S. Pat. No. 3,770,436 and Matsuo et al U.S. Pat. No. 3,808,945. Dye-forming couplers and nondye-forming compounds which upon coupling release a variety of photographically useful groups are described by Lau U.S. Pat. No. 4,248,962. DIR compounds which do not form dye upon reaction with oxidized color-developing agents can be employed, as illustrated by Fujiwhara et al German OLS 2,529,350 and U.S. Pat. Nos. 3,928,041, 3,958,993 and 3,961,959, Odenwalder et al German OLS 2,448,063, Tanaka et al German OLS 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129. Silver halide emulsions which are relatively light insensitive, such as Lippmann emulsions, have been utilized as interlayers and overcoat layers to prevent or control the migration of development inhibitor fragments as described in Shiba et al U.S. Pat. No. 3,892,572.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can include image dye stabilizers. Such image dye stabilizers are illustrated by U.K. Pat. No. 1,326,889, Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337 and Smith et al U.S. Pat. No. 4,042,394.

Dye images can be formed or amplified by processes which employ in combination with a dye-image-generating reducing agent an inert transition metal ion complex oxidizing agent, as illustrated by Bissonette U.S. Pat. Nos. 3,748,138, 3,682,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette *Research Disclosure,* Vol. 148, August 1976, Items 14836, 14846 and 14847. The photographic elements can be particularly adapted to form dye images by such processes, as illustrated by Dunn et al U.S. Pat. No. 3,822,129, Bissonette U.S. Pat. Nos. 3,834,907 and 3,902,905, Bissonette et al U.S. Pat. No. 3,847,619 and Mowrey U.S. Pat. No. 3,904,413.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

It is common practice in forming dye images in silver halide photographic elements to remove the silver which is developed by bleaching. Such removal can be enhanced by incorporation of a bleach accelerator or a precursor thereof in a processing solution or in a layer of the element. In some instances the amount of silver formed by development is small in relation to the amount of dye produced, particularly in dye image amplification, as described above, and silver bleaching is omitted without substantial visual effect. In still other applications the silver image is retained and the dye image is intended to enhance or supplement the density provided by the image silver. In the case of dye enhanced silver imaging it is usually preferred to form a neutral dye or a combination of dyes which together produce a neutral image. Neutral dye-forming couplers useful for this purpose are disclosed by Pupo et al *Research Disclosure,* Vol. 162, October 1977, Item 16226. The enhancement of silver images with dyes in photographic elements intended for thermal processing is disclosed in *Research Disclosure,* Vol. 173, September 1973, Item 17326, and Houle U.S. Pat. No. 4,137,079. It is also possible to form monochromatic or neutral dye images using only dyes, silver being entirely removed from the image-bearing photographic elements by bleaching and fixing, as illustrated by Marchant et al U.S. Pat. No. 3,620,747.

The photographic elements can be processed to form dye images which correspond to or are reversals of the silver halide rendered selectively developable by imagewise exposure. Reversal dye images can be formed in photographic elements having differentially spectrally sensitized silver halide layers by black-and-white development followed by (i) where the elements lack incorporated dye image formers, sequential reversal color development with developers containing dye image formers, such as color couplers, as illustrated by Mannes et al U.S. Pat. No. 2,252,718, Schwan et al U.S. Pat. No. 2,950,970 and Pilato U.S. Pat. No. 3,547,650; (ii) where the elements contain incorporated dye image formers, such as color couplers, a single color development step, as illustrated by the Kodak Ektachrome E4 and E6 and Agfa processes described in *British Journal of Photography Annual,* 1977, pp. 194–197, and *British Journal of Photography,* Aug. 2, 1974, pp. 668–669; and (iii) where the photographic elements contain bleachable dyes, silver-dye-bleach processing, as illustrated by the Cibachrome P-10 and P-18 processes described in the *British Journal of Photography Annual,* 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al U.S. Pat. No. 3,647,452, Puschel et al German Pat. No. 1,257,570 and U.S. Pat. Nos. 3,457,077 and 3,467,520, Accary-Venet et al U.K. Pat. No. 1,132,736, Schranz et al German Pat. No. 1,259,700, Marx et al German Pat. No. 1,259,701 and Muller-Bore German OLS 2,005,091.

Dye images which correspond to the silver halide rendered selectively developable by imagewise exposure, typically negative dye images, can be produced by processing, as illustrated by the Kodacolor C-22, the Kodak Flexicolor C-41 and the Agfacolor processes described in *British Journal of Photography Annual,* 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206, such processes being particularly suited to processing color print materials, such as resin-coated photographic papers, to form positive dye images.

The present invention can be employed to produce multicolor photographic images, as taught by Kofron et al, cited above. Generally any conventional multicolor imaging element containing at least one silver halide emulsion layer can be improved merely by adding or substituting a high aspect ratio tabular grain emulsion according to the present invention. The present invention is fully applicable to both additive multicolor imaging and subtractive multicolor imaging.

To illustrate the application of this invention to additive multicolor imaging, a filter array containing interlaid blue, green, and red filter elements can be employed in combination with a photographic element according to the present invention capable of producing a silver image. A high aspect ratio tabular grain emulsion of the present invention which is panchromatically sensitized and which forms a layer of the photographic element is imagewise exposed through the additive primary filter array. After processing to produce a silver image and viewing through the filter array, a multicolor image is seen. Such images are best viewed by projection. Hence both the photographic element and the filter array both have or share in common a transparent support.

Significant advantages can be realized also by the application of this invention to multicolor photographic elements which produce multicolor images from combinations of subtractive primary imaging dyes. Such photographic elements are comprised of a support and typically at least a triad of superimposed silver halide emulsion layers for separately recording blue, green, and red exposures as yellow, magenta, and cyan dye images, respectively.

Although only one tabular grain emulsion as described above is required, the multicolor photographic element contains at least three separate emulsions for recording blue, green, and red light, respectively. The emulsions other than the required high aspect ratio tabular grain green or red recording emulsion can be of any convenient conventional form. Various conventional emulsions are illustrated by *Research Disclosure,* Item 17643, cited above, Paragraph I, Emulsion preparation and types, here incorporated by reference. If more than one emulsion layer is provided to record in the blue, green, and/or red portion of the spectrum, it is preferred that at least the faster emulsion layer contain a high aspect ratio tabular grain emulsion as described above. It is, of course, recognized that all of the blue, green, and red recording emulsion layers of the photographic element can advantageously be tabular grain emulsions according to this invention, if desired.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from an adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al U.S. Pat. No. 2,937,086 and/or in interlayers between adjacent color-forming layer units, as illustrated by Weissberger et al U.S. Pat. No. 2,336,327.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three) blue, green, and/or red recording color-forming layer units in a single photographic element.

The multicolor photographic elements can take any convenient form consistent with the requirements indicated above. Any of the six possible layer arrangements of Table 27a, p. 221, disclosed by Gorokhovskii, *Spectral Studies of the Photographic Process,* Focal Press, New York, can be employed. To provide a simple, specific illustration, it is contemplated to add to a conventional multicolor silver halide photographic element during its preparation one or more high aspect ratio tabular grain emulsion layers sensitized to the minus blue portion of the spectrum and positioned to receive exposing radiation prior to the remaining emulsion layers. However, in most instances it is preferred to substitute one or more minus blue recording high aspect ratio tabular grain emulsion layers for conventional minus blue recording emulsion layers, optionally in combination with layer order arrangement modifications. Alternative layer arrangements can be better appreciated by reference to the following preferred illustrative forms.

Layer Order Arrangement I

Exposure
↓
B
IL
TG
IL
TR

Layer Order Arrangement II

Exposure
↓
TFB
IL
TFG
IL
TFR
IL
SB
IL
SG
IL
SR

Layer Order Arrangement III

Exposure
↓
TG
IL
TR
IL
B

Layer Order Arrangement IV

Exposure
↓
TFG
IL
TFR
IL
TSG
IL
TSR
IL
B

Layer Order Arrangement V

Exposure
↓
TFG
IL
TFR
IL
TFB
IL
TSG
IL
TSR
IL
SB

Layer Order Arrangement VI

Exposure
↓
TFR
IL
TB
IL
TFG
IL
TFR
IL
SG

-continued

| |
|---|
| IL |
| SR |
| Layer Order Arrangement VII |
| Exposure |
| ↓ |
| TFR |
| IL |
| TFG |
| IL |
| TB |
| IL |
| TFG |
| IL |
| TSG |
| IL |
| TFR |
| IL |
| TSR |

where

B, G, and R designate blue, green, and red recording color-forming layer units, respectively, of any conventional type;

T appearing before the color-forming layer unit B, G, or R indicates that the emulsion layer or layers contain tabular grain emulsions, as more specifically described above, F appearing before the color-forming layer unit B, G, or R indicates that the color-forming layer unit is faster in photographic speed than at least one other color-forming layer unit which records light exposure in the same third of the spectrum in the same Layer Order Arrangement;

S appearing before the color-forming layer unit B, G, or R indicates that the color-forming layer unit is slower in photographic speed than at least one other color-forming layer unit which records light exposure in the same third of the spectrum in the same Layer Order Arrangement; and IL designates an interlayer containing a scavenger, but substantially free of yellow filter material. Each faster or slower color-forming layer unit can differ in photographic speed from another color-forming layer unit which records light exposure in the same third of the spectrum as a result of its position in the Layer Order Arrangement, its inherent speed properties, or a combination of both.

In Layer Order Arrangements I through VII, the location of the support is not shown. Following customary practice, the support will in most instances be positioned farthest from the source of exposing radiation—that is, beneath the layers as shown. If the support is colorless and specularly transmissive—i.e., transparent, it can be located between the exposure source and the indicated layers. Stated more generally, the support can be located between the exposure source and any color-forming layer unit intended to record light to which the support is transparent.

Although photographic emulsions intended to form multicolor images comprised of combinations of subtractive primary dyes normally take the form of a plurality of superimposed layers containing incorporated dye-forming materials, such as dye-forming couplers, this is by no means required. Three color-forming components, normally referred to as packets, each containing a silver halide emulsion for recording light in one third of the visible spectrum and a coupler capable of forming a complementary subtractive primary dye, can be placed together in a single layer of a photographic element to produce multicolor images. Exemplary mixed packet multicolor photographic elements are disclosed by Godowsky U.S. Pat. Nos. 2,698,794 and 2,843,489. Although discussion is directed to the more common arrangement in which a single color-forming layer unit produces a single subtractive primary dye, relevance to mixed packet multicolor photographic elements will be readily apparent.

Figure 6:
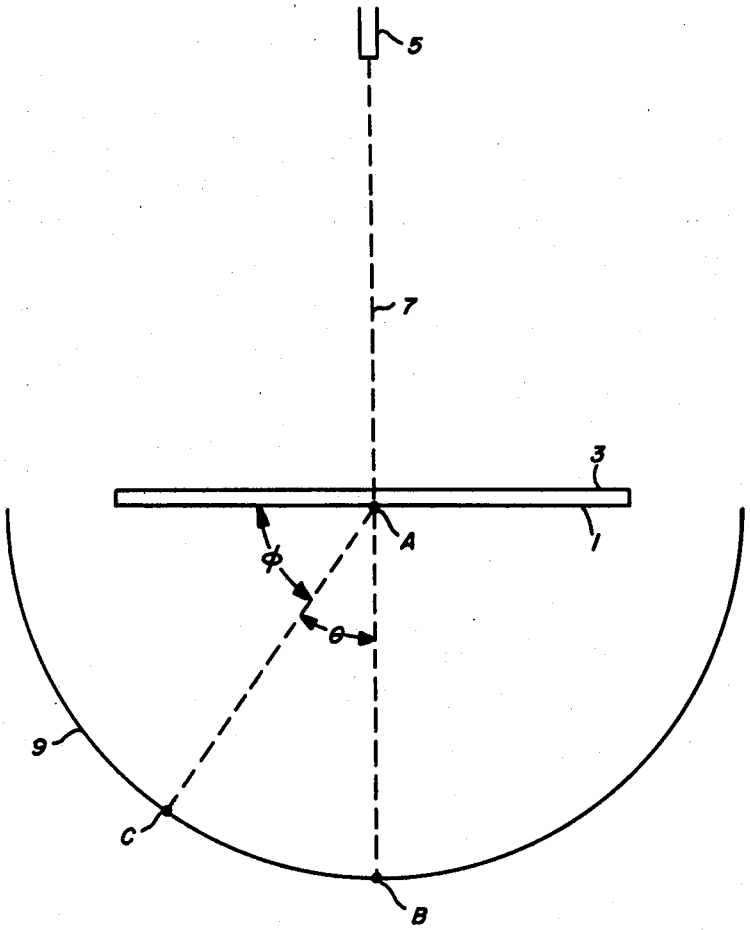
FIG. 6 is a schematic diagram for illustrating sharpness characteristics.

As described by Kofron et al, cited above, the high aspect ratio tabular grain silver chlorobromide emulsions of the present invention are advantageous because of their reduced high angle light scattering as compared to nontabular and lower aspect ratio tabular grain emulsions. This can be quantitatively demonstrated. Referring to FIG. 6, a sample of an emulsion 1 according to the present invention is coated on a transparent (specularly transmissive) support 3 at a silver coverage of 1.08 $g/m^2$. Although not shown, the emulsion and support are preferably immersed in a liquid having a substantially matched refractive index to minimize Fresnel reflections at the surfaces of the support and the emulsion. The emulsion coating is exposed perpendicular to the support plane by a collimated light source 5. Light from the source following a path indicated by the dashed line 7, which forms an optical axis, strikes the emulsion coating at point A. Light which passes through the support and emulsion can be sensed at a constant distance from the emulsion at a hemispherical detection surface 9. At a point B, which lies at the intersection of the extension of the initial light path and the detection surface, light of a maximum intensity level is detected.

An arbitrarily selected point C is shown in FIG. 6 on the detection surface. The dashed line between A and C forms an angle $\phi$ with the emulsion coating. By moving point C on the detection surface it is possible to vary $\phi$ from 0° to 90°. By measuring the intensity of the light scattered as a function of the angle $\phi$ it is possible (because of the rotational symmetry of light scattering about the optical axis 7) to determine the cumulative light distribution as a function of the angle $\phi$. (For a background description of the cumulative light distribution see DePalma and Gasper, "Determining the Optical Properties of Photographic Emulsions by the Monte Carlo Method", *Photographic Science and Engineering*, Vol. 16, No. 3, May-June 1971, pp. 181-191.)

After determining the cumulative light distribution as a function of the angle $\phi$ at values from 0° to 90° for the emulsion 1 according to the present invention, the same procedure is repeated, but with a conventional emulsion of the same average grain volume coated at the same silver coverage on another portion of support 3. In comparing the cumulative light distribution as a function of the angle $\phi$ for the two emulsions, for values of $\phi$ up to 70° (and in some instances up to 80° and higher) the amount of scattered light is lower with the emulsions according to the present invention. In FIG. 6 the angle $\theta$ is shown as the complement of the angle . The angle of scattering is herein discussed by reference to the angle $\theta$. Thus, the high aspect ratio tabular grain emulsions of this invention exhibit less high-angle scattering. Since it is high-angle scattering of light that contributes disproportionately to reduction in image sharpness, it follows that the high aspect ratio tabular grain emulsions of the present invention are in each instance capable of producing sharper images.

As herein defined the term "collection angle" is the value of the angle $\theta$ at which half of the light striking the detection surface lies within an area subtended by a cone formed by rotation of line AC about the polar axis at the angle $\theta$ while half of the light striking the detection surface strikes the detection surface within the remaining area.

While not wishing to be bound by any particular theory to account for the reduced high angle scattering properties of high aspect ratio tabular grain emulsions according to the present invention, it is believed that the large flat major crystal faces presented by the high aspect ratio tabular grains as well as the orientation of the grains in the coating account for the improvements in sharpness observed. Specifically, it has been observed that the tabular grains present in a silver halide emulsion coating are substantially aligned with the planar support surface on which they lie. Thus, light directed perpendicular to the photographic element striking the emulsion layer tends to strike the tabular grains substantially perpendicular to one major crystal face. The thinness of tabular grains as well as their orientation when coated permits the high aspect ratio tabular grain emulsion layers of this invention to be substantially thinner than conventional emulsion coatings, which can also contribute to sharpness. However, the emulsion layers of this invention exhibit enhanced sharpness even when they are coated to the same thicknesses as conventional emulsion layers.

In a specific preferred form of the invention the high aspect ratio tabular grain silver chlorobromide emulsion layers exhibit a minimum average grain diameter of at least 1.0 micron, most preferably at least 2 microns. Both improved speed and sharpness are attainable as average grain diameters are increased. While maximum useful average grain diameters will vary with the graininess that can be tolerated for a specific imaging application, the maximum average grain diameters of high aspect ratio tabular grain emulsions according to the present invention are preferably less than 30 microns and optimally no greater than 10 microns.

Although it is possible to obtain reduced collection angles with single layer coatings of high aspect ratio tabular grain emulsions according to the present invention, it does not follow that lower collection angles are necessarily realized in multicolor coatings. In certain multicolor coating formats enhanced sharpness can be achieved with the high aspect ratio tabular grain emulsions of this invention, but in other multicolor coating formats the high aspect ratio tabular grain emulsions of this invention can actually degrade the sharpness of underlying emulsion layers.

Referring back to Layer Order Arrangement I, it can be seen that the blue recording emulsion layer lies nearest to the exposing radiation source while the underlying green recording emulsion layer is a tabular emulsion according to this invention. The green recording emulsion layer in turn overlies the red recording emulsion layer. If the blue recording emulsion layer contains grains having an average diameter in the range of from 0.2 to 0.6 micron, as is typical of many nontabular emulsions, it will exhibit maximum scattering of light passing through it to reach the green and red recording emulsion layers. Unfortunately, if light has already been scattered before it reaches the high aspect ratio tabular grain emulsion forming the green recording emulsion layer, the tabular grains can scatter the light passing through to the red recording emulsion layer to an even greater degree than a conventional emulsion. Thus, this particular choice of emulsions and layer arrangement results in the sharpness of the red recording emulsion layer being significantly degraded to an extent greater than would be the case if no emulsions according to this invention were present in the layer order arrangement.

In order to realize fully the sharpness advantages in an emulsion layer that underlies a tabular grain emulsion layer according to the present invention it is preferred that the the tabular grain emulsion layer be positioned to receive light that is free of significant scattering (preferably positioned to receive substantially specularly transmitted light). Stated another way, improvements in sharpness in emulsion layers underlying tabular grain emulsion layers are best realized only when the tabular grain emulsion layer does not itself underlie a turbid layer. For example, if a tabular grain green recording emulsion layer overlies a red recording emulsion layer and underlies a Lippmann emulsion layer and/or a tabular grain blue recording emulsion layer according to this invention, the sharpness of the red recording emulsion layer will be improved by the presence of the overlying tabular grain emulsion layer or layers. Stated in quantitative terms, if the collection angle of the layer or layers overlying the tabular grain green recording emulsion layer is less than about 10°, an improvement in the sharpness of the red recording emulsion layer can be realized. It is, of course, immaterial whether the red recording emulsion layer is itself a tabular grain emulsion layer according to this invention insofar as the effect of the overlying layers on its sharpness is concerned.

In a multicolor photographic element containing superimposed color-forming units it is preferred that at least the emulsion layer lying nearest the source of exposing radiation be a tabular grain emulsion in order to obtain the advantages of sharpness. In a specifically preferred form each emulsion layer which lies nearer the exposing radiation source than another image recording emulsion layer is a tabular grain emulsion layer. Layer Order Arrangements II, III, IV, V, VI, and VII, described above, are illustrative of multicolor photographic element layer arrangements which are capable of imparting significant increases in sharpness to underlying emulsion layers.

Although the advantageous contribution of tabular grain silver halide emulsions to image sharpness in multicolor photographic elements has been specifically described by reference to multicolor photographic elements, sharpness advantages can also be realized in multilayer black-and-white photographic elements intended to produce silver images. It is conventional practice to divide emulsions forming black-and-white images into faster and slower layers. By employing tabular grain emulsions according to this invention in layers nearest the exposing radiation source the sharpness of underlying emulsion layers will be improved.

EXAMPLES

The invention can be better appreciated by reference to the following specific examples. In each of the examples the contents of the reaction vessel were stirred vigorously throughout silver and halide salt introductions; the term "percent" means percent by weight, unless otherwise indicated; the term "M" stands for a molar concentration, unless otherwise indicated; and the term "N" stands for a normal concentration, unless otherwise indicated. All solutions, unless otherwise stated, are aqueous solutions.

EXAMPLE 1

To 6 liters of a vigorously stirred 3% gelatin 0.47 M potassium chloride, 0.01 M potassium bromide solution at 55° C. were added by double jet, a 1.72 M potassium bromide solution which was also 1.24 M in potassium chloride and a 2.0 M silver nitrate solution, over a period of 5 min, maintaining the pAg as read prior to the commencement of the halide and silver additions (consuming 3.8% of the total silver used). Addition of the two solutions was then continued over a period of 64 min in an accelerated flow (3X from start to finish—i.e., three times faster at the end than at the start) while maintaining pAg unchanged and consuming 96.2% of the total silver used. The molarity of chloride and bromide ions in the reaction vessel during precipitation was held constant at 0.48 M and the molar ratio of chloride ions to bromide ions was 47:1. A total of 4 moles of silver was used. The emulsion was then cooled and coagulation-washed by the method of Yutzy and Russell U.S. Pat. No. 2,614,929.

As shown in FIG. 1 a silver chlorobromide emulsion was obtained comprised of a very high proportion of tabular grains. The tabular grains accounted for approximately 80 percent of total projected area of the grains. The average aspect ratio of the emulsion was 10:1, and the average thickness of the tabular grains was 0.15 micron. While some tabular grains having a diameter of less than 0.6 micron in diameter may have been included in determining the average aspect ratio and projected areas reported in the examples, they were not present in numbers sufficient to alter significantly the results reported. The halide content of the emulsion was 85 mole percent bromide and 15 mole percent chloride.

EXAMPLES 2 THROUGH 5

The procedure of Example 1 was repeated, but with the normality of the total halide ion in the reaction vessel being varied (i.e., the precipitation pAg being varied) and other parameters unchanged.

The results of Examples 1 through 5, wherein Examples 1 and 4 constitute preferred embodiments of the invention and Example 2 is a control, are reported below in Table II.

TABLE II

| Example | Normality of Halide Ions | Average Grain Thickness (μm) | Average Aspect Ratio | Percent of Projected Areas | FIG. |
|---|---|---|---|---|---|
| 2 (Comparative) | 0.048 | * | * | * | 2 |
| 3 | 0.240 | 0.14 | 7:1 | 35 | 3 |
| 4 | 0.361 | 0.15 | 11:1 | 78 | 4 |
| 1 | 0.480 | 0.15 | 10:1 | 80 | 1 |
| 5 | 0.720 | 0.15 | 10:1 | 43 | 5 |

*nontabular grains

EXAMPLE 6

To 1.95 liters of a vigorously stirred 1.5% gelatin 0.168 M potassium bromide solution at 80° C. were added by double jet over a period of 2 min a 2.20 M potassium bromide solution and a 2.0 M silver nitrate solution at a rate consuming 2.8% of the total silver used, while maintaining the pAg recorded prior to the initiation of the runs. The addition of the bromide and silver nitrate solutions was then continued in an accelerated flow (11.4X from start to finish) over a period of 6 min, maintaining the same pAg and consuming 52.6% of the total silver used. Thirty ml of a 0.68 M sodium chloride solution was then added, followed by an addition of the silver nitrate solution over a period of 1.5 min at a flow rate consuming 22.5% of the total silver used, and attaining a pAg value 3 pAg units lower than the original pAg value. A 1.4 M potassium bromide solution which was also 0.61 M in sodium chloride and the 2.0 M silver nitrate solution were then added concurrently over a period of 2.2 min at a constant equal flow rate consuming 22.1% of the total silver used and while maintaining constant pAg. The pAg was then adjusted downward by 0.4 pAg unit. A total of 2.2 moles of silver was used.

The grains contained silver bromide central grain regions and annular grain regions laterally surrounding the central grain regions consisting essentially of silver chlorobromide. The tabular grains of less than 0.3 micron in thickness and at least 0.6 micron in diameter exhibited an average aspect ratio of 10:1 and accounted for approximately 90 percent of total projected area of the silver halide grains present. The grains had an average thickness of approximately 0.16 micron and an average diameter of 1.6 micron. The overall halide content of the emulsion was 93 mole percent bromide and 7 mole percent chloride.

EXAMPLE 7

To 6.0 liters of a vigorously stirred 0.168 M potassium bromide solution containing 1.5% gelatin at 55° C. were added by double jet over a period of 12 min a 2.0 M potassium bromide solution and a 2.0 M silver nitrate solution while maintaining the pAg at the value recorded prior to the addition, and consuming 9.1% of the total silver used. When the addition of these solutions was halted, diafiltration of the reaction vessel contents was used to lower the pAg within the reaction vessel by 1.23 pAg units. A 2.0 liter solution of 1.88 M potassium chloride which was also 0.01 M in potassium bromide was added to raise the reaction vessel's volume to 8 liters providing a $[Cl^-]/[Br^-]$ ratio of 47:1. A 1.72 M potassium bromide solution which was also 1.24 M in potassium chloride was added concurrently with the 2.0 M silver nitrate solution at an equal constant rate over a period of 2 hr, consuming 90.9% of the total silver used. During silver chlorobromide precipitation, the halide concentration in the reaction vessel was 0.48 M. A total of 4 moles of silver was used in preparing the emulsion. At the conclusion of precipitation the emulsion was washed in the manner of Example 1.

The grains contained silver bromide central grain regions and annular grain regions laterally surrounding the central grain regions consisting essentially of silver chlorobromide. The tabular grains of less than 0.3 micron in thickness and at least 0.6 micron in diameter exhibited an average aspect ratio of 7.5:1 and accounted for approximately 85 percent of the total projected area of the silver halide grains present. The grains had an average thickness of 0.17 micron and an average diameter of 1.3 microns. The overall halide content of the emulsion was 86 mole percent bromide and 14 mole percent chloride.

EXAMPLE 8 (A COMPARATIVE EXAMPLE)

Example 7 was repeated, except that the concentration of total halide ions during silver chlorobromide precipitation was reduced to 0.048 M. The tabular grains produced had a smaller average diameter, 0.82 micron, versus 1.30 microns in Example 7, and were thicker, 0.21 micron in thickness as compared to 0.17 in Example 7.

EXAMPLE 9

The high aspect ratio tabular grain AgClBr emulsion employed in this example was prepared as described in Example 1. The resultant high aspect ratio tabular grain AgClBr (≈15:85) emulsion had an average tabular grain diameter of 1.5 μm, an average tabular grain thickness of 0.15 μm, and an average aspect ratio of 10:1. The tabular grains having a thickness of less than 0.30 μm and a diameter of at least 0.6 μm accounted for approximately 80 percent of the total projected area of the grains. The tabular AgClBr emulsion had an average volume/grain of 0.49 $\mu m^3$.

Control AgClBr Emulsion A was prepared by the halide conversion process described below.

A solution of 170 grams of silver nitrate in 460 ml of distilled water at 40° C. was added with stirring over a period of about 15 minutes to a solution of 25 grams of a pH sensitive gelatin derivative and 85 grams of potassium chloride in 1 liter of distilled water at a temperature of 65° C. Immediately following the end of the silver nitrate addition, the addition of a solution of 122 grams of potassium bromide in 425 ml of distilled water at 65° C. was run into the making vessel over a period of about 28 minutes. Following the completion of the potassium bromide run, the emulsion was held with stirring at a temperature of 65° C. for about 15 minutes and then cooled to about 33° C. The emulsion pH was then lowered to 3.8, and the coagulated emulsion was chilled to about 5° C. and allowed to settle and supernatant liquid was then removed. The emulsion was then redispersed in the original volume of distilled water at 40° C. and the pH was adjusted to 6.0. The pH was then lowered to 4.0, the temperature dropped to about 5° C. and the coagulated emulsion was again allowed to settle and the supernatant liquid was removed. The emulsion was then redispersed at 40° C., gelatin was added and the pH and pAg were adjusted to 5.5 and 8.4, respectively. The halide concentration of the resulting silver chlorobromide emulsion was about 15 mole percent chloride and about 85 mole percent bromide. The resultant nontabular grain AgClBr emulsion had an average volume/grain of 0.69 $\mu m^3$.

The high aspect ratio tabular grain AgClBr was optimally sensitized in the following manner. The emulsion was chemically finished with 4.0 mg sodium thiosulfate pentahydrate/Ag mole and 4.0 mg potassium tetrachloroaurate/Ag mole for 20 minutes at 70° C. and then spectrally sensitized with 400 mg of anhydro-5,6-dimethoxy-5'-methylthio-3,3'-di-(3-sulfopropyl)thiacyanine hydroxide, triethylamine salt/Ag mole. Then 200 mg 4-hydroxy-6-methyl-1,3,3a,7-tetraazaindene/Ag mole was aded to the sensitized emulsion.

Control AgClBr Emulsion A was optimally sensitized in the following manner. The emulsion was chemically sensitized with 10 mg sodium thiosulfate pentahydrate/Ag mole, 2.0 mg potassium tetrachloroaurate/Ag mole, and 140 mg 4-hydroxy-6-methyl-1,3,3a,7-tetraazaindene/Ag mole held for 20 mintes at 65° C. and then spectrally sensitized with 200 mg anhydro-5,6-dimethoxy-5'-methylthio-3,3'-di-(3-sulfopropyl)thiacyanine hydroxide, triethylamine salt/Ag mole.

Both the tabular grain AgClBr emulsion and control AgClBr Emulsion A were separately coated on cellulose triacetate film support at 2.15 g silver/$m^2$ and 8.6 g gelatin/$m^2$.

To determine as a reference point the intrinsic sensitivity of the silver halide emulsions the coatings were exposed for 1 second to a mercury vapor lamp at 365 nm wavelength through a 0–4.0 continuous density tablet and processed for 3 minutes at 20° C. in an N-methyl-p-aminophenol sulfate-hydroquinone developer (Kodak Developer DK-50 ®). To evaluate the spectral response, the coatings were also exposed for 1 second to a 600 W 5500° K. tungsten light source through a 0–4.0 continuous density tablet plus a Wratten No. 47 filter and processed for 3 minutes at 20° C. in Kodak Developer DK-50. Relative speed values were recorded at 0.30 density units above fog. As illustrated in Table III below, both the tabular grain and nontabular grain converted-halide AgClBr emulsion coatings were of equivalent intrinsic speed. However when optimally chemically and spectrally sensitized, the tabular grain AgClBr emulsion coating was of superior speed in the blue spectral region.

TABLE III

| | Intrinsic* | | Blue** | |
|---|---|---|---|---|
| Emulsion | Speed | Fog | Speed | Fog |
| Example 1 (Tabular) | 379 | 0.07 | 195 | 0.07 |
| Control A (Nontabular) | 374 | 0.11 | 173 | 0.11 |

*365 line exposure
**600W 5500° K. Wratten No. 47 Exposure

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains including tabular grains having opposed, substantially parallel {111} major faces, said tabular grains containing chloride and bromide in at least annular grain regions, said tabular grains having a thickness of less than 0.3 micron, a diameter of at least 0.6 micron, and an average aspect ratio of at least 5:1 accounting for at least 35 percent of the total projected area of said silver halide grains, and the average molar ratio of chloride to bromide in at least said annular grain regions ranging up to 2:3.

2. A radiation-sensitive emulsion according to claim 1 wherein the average aspect ratio is greater than 8:1.

3. A radiation-sensitive emulsion according to claim 1 wherein said dispersing medium contains a peptizer.

4. A radiation-sensitive emulsion according to claim 3 wherein said peptizer is gelatin or a gelatin derivative.

5. A radiation-sensitive emulsion according to claim 1 wherein said tabular grains account for at least 50 percent of the total projected area of said silver halide grains.

6. A radiation-sensitive emulsion according to claim 1 wherein the molar ratio of chloride to bromide is at least 1:99.

7. A radiation-sensitive emulsion according to claim 1 wherein said tabular grains additionally contain iodide.

8. A radiation-sensitive emulsion according to claim 1 wherein said silver halide grains are substantially free of chloride in a central region.

9. A radiation-sensitive emulsion according to claim 1 wherein said tabular grains include a central region which consists essentially of silver bromide.

10. A radiation-sensitive emulsion comprised of a dispersing medium and silver chlorobromide grains, at least 50 percent of the total projected area of said silver chlorobromide grains, being provided by tabular grains having a thickness of less than 0.3 micron, a diameter of at least 0.6 micron, and an average aspect ratio of greater than 8:1, and said silver chlorobromide grains containing from 1 to 30 mole percent chloride.

11. A radiation-sensitive emulsion according to claim 10 in which said tabular grains account for at least 70 percent of the total projected area of said silver chlorobromide grains.

12. A radiation-sensitive emulsion according to claim 10 in which said silver chlorobromide grains contain from 5 to 20 mole percent chloride.

13. In a photographic element comprised of a support and at least one radiation-sensitive emulsion layer, the improvement wherein said emulsion layer is comprised of an emulsion according to claim 1, 2, 3, 4, 5, 6, 7, 8, 9, 10, 11, or 12.

14. A process of producing a visible photographic image comprising processing in an aqueous alkaline solution in the presence of a developing agent an imagewise exposed photographic element according to claim 13.

15. In a process of preparing a radiation-sensitive emulsion comprised of a dispersing medium and silver halide grains containing chloride and bromide by concurrently introducing silver, chloride, and bromide salts into a reaction vessel containing at least a portion of the dispersing medium, the improvement wherein tabular silver halide grains containing chloride and bromide in a molar ratio of chloride to bromide of from 1:99 to 2:3 in at least an annular grain region are formed, during introduction of the silver, chloride, and bromide salts, by maintaining a molar ratio of chloride to bromide ions in the reaction vessel of from 1.6:1 to 258:1, and maintaining the total concentration of halide ions in the reaction vessel in the range of from 0.10 to 0.90 normal.

16. An improved process according to claim 15, wherein a peptizer is introduced into the reaction vessel so that it is present during the coprecipitation of chloride and bromide.

17. An improved process according to claim 15, wherein the contents of the reaction vessel are maintained within the temperature range of from 30 to 90° C. during the coprecipitation of chloride and bromide.

18. An improved process according to claim 17, wherein the contents of the reaction vessel are maintained within the temperature range of from 40 to 80° C. during the coprecipitation of chloride and bromide.

19. An improved process according to claim 15, wherein the halide ion concentration is maintained within the range of from 0.30 to 0.60 N during the coprecipitation of chloride and bromide.

20. An improved process according to claim 19, wherein the molar ratio of chloride to bromide ions in the reaction vessel is maintained in the range of from 1.6:1 to 184:1 during coprecipitation of chloride and bromide.

21. An improved process according to claim 15, wherein an iodide salt is introduced into the reaction vessel during the coprecipitation of chloride and bromide.

22. An improved process according to claim 15, wherein the reaction vessel is maintained substantially free of silver halide grains prior to the concurrent introduction of silver, bromide, and chloride salts.

23. An improved process according to claim 15, which comprises forming in the reaction vessel or introducing into the reaction vessel prior to the concurrent introduction of silver, bromide, and chloride salts, silver halide grains.

24. An improved process according to claim 23, which comprises initially forming in the reaction vessel or introducing into the reaction vessel, silver halide grains that are substantially free of chloride prior to the concurrent introduction of silver, bromide, and chloride salts.

25. An improved process according to claim 24, which comprises initially forming in the reaction vessel or introducing into the reaction vessel silver bromide grains prior to the concurrent introduction of silver, bromide, and chloride salts.

26. A radiation-sensitive emulsion comprised of a dispersing medium and silver halide grains including tabular grains having opposed, substantially parallel {1111} major faces, said tabular grains containing chloride and bromide in at least annular grain regions, said tabular grains having a thickness of less than 0.5 micron, a diameter of at least 0.6 micron, and an average aspect ratio of at least 5:1 accounting for at least 35 percent of the total projected area of said silver halide grains, and the average molar ratio of chloride to bromide in at least said annular grain regions ranging up to 2:3.

27. A radiation-sensitive emulsion according to claim 26 wherein the average aspect ratio is greater than 8:1.

28. A radiation-sensitive emulsion according to claim 26 wherein said dispersing medium contains a peptizer.

29. A radiation-sensitive emulsion according to claim 28 wherein said peptizer is gelatin or a gelatin derivative.

30. A radiation-sensitive emulsion according to claim 26 wherein said tabular grains account for least 50 percent of the total projected area of said silver halide grains.

31. A radiation-sensitive emulsion according to claim 26 wherein the molar ratio of chloride to bromide is at least 1:99.

32. A radiation-sensitive emulsion according to claim 26 wherein the said tabular grains additionally contain iodide.

33. A radiation-sensitive emulsion according to claim 26 wherein said silver halide grains are substantially free of chloride in a central region.

34. A radiation-sensitive emulsion according to claim 26 wherein said tabular grains include a central region which consists essentially of silver bromide.

35. In a photographic element comprised of a support and at least one radiation-sensitive emulsion layer, the improvement wherein said emulsion layer is comprised of an emulsion according to claim 26, 27, 28, 29, 30, 31, 32, 33, or 34.

36. A process of producing a visible photographic image comprising processing in an aqueous alkaline solution in the presence of a developing agent an imagewise exposed photographic element according to claim 35.

* * * * *